US009732691B2

(12) United States Patent
Okazaki et al.

(10) Patent No.: US 9,732,691 B2
(45) Date of Patent: Aug. 15, 2017

(54) CONTROL SYSTEM OF INTERNAL COMBUSTION ENGINE

(71) Applicants: Shuntaro Okazaki, Shizuoka (JP); Norihisa Nakagawa, Susono (JP); Yuji Yamaguchi, Susono (JP)

(72) Inventors: Shuntaro Okazaki, Shizuoka (JP); Norihisa Nakagawa, Susono (JP); Yuji Yamaguchi, Susono (JP)

(73) Assignee: TOYOTA JIDOSHA KABUSHIKI KAISHA, Toyota-shi, Aichi (JP)

( * ) Notice: Subject to any disclaimer, the term of this patent is extended or adjusted under 35 U.S.C. 154(b) by 0 days.

(21) Appl. No.: 14/762,501

(22) PCT Filed: Jan. 29, 2013

(86) PCT No.: PCT/JP2013/051909
§ 371 (c)(1),
(2) Date: Jul. 22, 2015

(87) PCT Pub. No.: WO2014/118890
PCT Pub. Date: Aug. 7, 2014

(65) Prior Publication Data

US 2015/0322878 A1 Nov. 12, 2015

(51) Int. Cl.

| | |
|---|---|
| ***F01N 3/00*** | (2006.01) |
| ***F01N 3/10*** | (2006.01) |
| ***F02D 41/14*** | (2006.01) |
| ***F01N 3/20*** | (2006.01) |
| ***F02D 41/02*** | (2006.01) |
| *F01N 13/00* | (2010.01) |

(52) U.S. Cl.
CPC ..... *F02D 41/1454* (2013.01); *F01N 3/20* (2013.01); *F02D 41/0295* (2013.01);
(Continued)

(58) Field of Classification Search
CPC ..... F01N 13/009; F01N 13/0093; F01N 2430/06; F01N 2560/025; F01N 2560/14;
(Continued)

(56) References Cited

U.S. PATENT DOCUMENTS 5,758,490 A 6/1998 Maki et al.
6,282,889 B1 * 9/2001 Kakuyama ..... F02D 41/0295 60/274

(Continued)

FOREIGN PATENT DOCUMENTS

JP H08-232723 A 9/1996
JP 2000-356618 A 12/2000

(Continued)

*Primary Examiner* — Phutthiwat Wongwian
*Assistant Examiner* — Diem Tran
(74) *Attorney, Agent, or Firm* — Andrews Kurth Kenyon LLP

(57) ABSTRACT

A control device for an internal combustion engine includes: an upstream catalyst; a downstream catalyst that is provided further downstream than the upstream catalyst in the exhaust flow direction; a downstream air-fuel ratio detection device that is provided between these catalysts; a storage amount estimation device that estimates the oxygen storage amount of the downstream catalyst; and an inflow air-fuel ratio control device that controls the air-fuel ratio of the exhaust gas flowing into the upstream catalyst such that the air-fuel ratio of the exhaust gas reaches a target air-fuel ratio.

12 Claims, 17 Drawing Sheets

(52) U.S. Cl.
CPC ..... *F02D 41/1439* (2013.01); *F01N 13/009* (2014.06); *F01N 13/0093* (2014.06); *F01N 2430/06* (2013.01); *F01N 2560/025* (2013.01); *F01N 2560/14* (2013.01); *F01N 2900/1624* (2013.01)

(58) Field of Classification Search
CPC ..... F01N 2900/1624; F01N 3/20; F02D 41/0295; F02D 41/1439; F02D 41/1454
USPC ..... 60/285, 299
See application file for complete search history.

(56) References Cited

U.S. PATENT DOCUMENTS

| | | | | |
|---|---|---|---|---|
| 7,117,665 | B2 * | 10/2006 | Kamoto | F01N 3/101 60/274 |
| 8,069,652 | B2 * | 12/2011 | Iihoshi | F01N 11/007 60/276 |
| 2001/0054283 | A1 * | 12/2001 | Tayama | B01D 53/9431 60/285 |
| 2002/0040577 | A1 * | 4/2002 | Kamoto | F01N 11/007 60/277 |
| 2002/0152743 | A1 | 10/2002 | Nakamura | |

FOREIGN PATENT DOCUMENTS

| | | | |
|---|---|---|---|
| JP | 2001-234787 | A | 8/2001 |
| JP | 2005-351096 | A | 12/2005 |
| JP | 2009-162139 | A | 7/2009 |
| JP | 2011-069337 | A | 4/2011 |

* cited by examiner (A)

(B)

(A)

(B)

(C)

CONTROL SYSTEM OF INTERNAL COMBUSTION ENGINE

CROSS-REFERENCE TO RELATED APPLICATION

This is a national phase application based on the PCT International Patent Application No. PCT/JP2013/051909 filed Jan. 29, 2013, the entire contents of which are incorporated herein by reference.

TECHNICAL FIELD

The present invention relates to a control system of an internal combustion engine which controls an internal combustion engine in accordance with output of an air-fuel ratio sensor.

BACKGROUND ART

In the past, a control system of an internal combustion engine which is provided with an air-fuel ratio sensor in an exhaust passage of the internal combustion engine, and controls an amount of fuel fed to the internal combustion engine based on the output of the air-fuel ratio sensor, has been widely known (for example, see PLTs 1 to 4).

In such a control system, an upstream side catalyst and downstream side catalyst which are provided in the exhaust passage and have oxygen storage abilities are used. A catalyst having an oxygen storage ability can purify unburned gas (HC, CO, etc.) or $NO_X$, etc. in the exhaust gas flowing into the catalyst, when the oxygen storage amount is a suitable amount between an upper limit storage amount and a lower limit storage amount. That is, if exhaust gas of an air-fuel ratio richer than a stoichiometric air-fuel ratio (below, also called a "rich air-fuel ratio") flows into the catalyst, the unburned gas in the exhaust gas is oxidized and purified by the oxygen stored in the catalyst. Conversely, if exhaust gas of an air-fuel ratio leaner than the stoichiometric air-fuel ratio (below, also called a "lean air-fuel ratio") flows into the catalyst, the oxygen in the exhaust gas is stored in the catalyst. Due to this, the surface of the catalyst becomes an oxygen deficient state and, along with this, $NO_X$ in the exhaust gas is reduced and purified. As a result, the catalyst can purify exhaust gas regardless of the air-fuel ratio of the exhaust gas flowing into the catalyst so long as the oxygen storage amount is a suitable amount.

Therefore, in such a control system, to maintain the oxygen storage amount at the upstream side catalyst at a suitable amount, an air-fuel ratio sensor is provided at the upstream side, in the direction of flow of exhaust, from the upstream side catalyst, and an oxygen sensor is provided at the downstream side, in the direction of flow of exhaust, from the upstream side catalyst and at the upstream side, in the direction of flow of exhaust, from the downstream side catalyst. Using these sensors, the control system performs feedback control, based on the output of the upstream side air-fuel ratio sensor, so that the output current of this air-fuel ratio sensor becomes a target value corresponding to the target air-fuel ratio. In addition, the control system adjusts the target value of the upstream side air-fuel ratio sensor, based on the output of the downstream side oxygen sensor.

For example, in the control system described in PLT 1, when the output voltage of the downstream side oxygen sensor is a high side threshold value or more and the state of the upstream side catalyst is an oxygen deficient state, the target air-fuel ratio of the exhaust gas flowing into the upstream side catalyst is set to the lean air-fuel ratio. Conversely, when the output voltage of the downstream side oxygen sensor is at the low side threshold value or less and the state of the upstream side catalyst is an oxygen excess state, the target air-fuel ratio is set to the rich air-fuel ratio. According to PLT 1, due to this, when in the oxygen deficient state or oxygen excess state, it is possible to return the state of the catalyst quickly to a state in the middle of these two states (that is, state where catalyst stores a suitable amount of oxygen).

In addition, in the above control system, if the output voltage of the downstream side oxygen sensor is between the high side threshold value and the low side threshold value, when the output voltage of the oxygen sensor is in an increasing trend, the target air-fuel ratio is set to the lean air-fuel ratio. Conversely, when the output voltage of the oxygen sensor is in a decreasing trend, the target air-fuel ratio is set to the rich air-fuel ratio. According to PLT 1, due to this, it is considered that the state of the upstream side catalyst can be prevented in advance from becoming an oxygen deficient state or oxygen excess state.

CITATIONS LIST

Patent Literature

PLT 1: Japanese Patent Publication No. 2011-069337A
PLT 2: Japanese Patent Publication No. 2005-351096A
PLT 3: Japanese Patent Publication No. 2000-356618A
PLT 4: Japanese Patent Publication No. H8-232723A
PLT 5: Japanese Patent Publication No. 2009-162139A
PLT 6: Japanese Patent Publication No. 2001-234787A

SUMMARY OF INVENTION

Technical Problem

In the meantime, in the control system described in PLT 1, when the output voltage of the downstream side oxygen sensor is the high side threshold value or more and the state of the upstream side catalyst is an oxygen deficient state, the target air-fuel ratio of the exhaust gas flowing into the upstream side catalyst 20 is set to a lean air-fuel ratio. That is, in this control system, when the state of the catalyst is an oxygen deficient state and unburned gas flows out from the upstream side catalyst, the target air-fuel ratio is set to the lean air-fuel ratio. Therefore, some unburned gas flows out from the upstream side catalyst.

Further, in the control system described in PLT 1, when the output voltage of the downstream side oxygen sensor is the low side threshold value or less and the state of the catalyst is an oxygen excess state, the target air-fuel ratio is set to the rich air-fuel ratio. That is, in this control system, when the state of the catalyst is an oxygen excess state and oxygen and $NO_X$ flow out from the upstream side catalyst, the target air-fuel ratio is set to the rich air-fuel ratio. Therefore, some $NO_X$ flows out from the upstream side catalyst.

Accordingly, sometimes both unburned gas and $NO_X$ flow out from the upstream side catalyst. If both unburned gas and $NO_X$ flow out from the upstream side catalyst in this way, the downstream side catalyst has to purify both these components.

Therefore, the inventors proposed performing air-fuel ratio control which alternately sets the target air-fuel ratio of the exhaust gas flowing into the upstream side catalyst between a lean set air-fuel ratio which is leaner by a certain extent than the stoichiometric air-fuel ratio and a weak rich set air-fuel ratio which is slighter richer than the stoichiometric air-fuel ratio. Specifically, in such air-fuel ratio control, when the air-fuel ratio of the exhaust gas which is detected by the downstream side air-fuel ratio sensor arranged at the downstream side of the upstream side catalyst is a rich judged air-fuel ratio, which is richer than the stoichiometric air-fuel ratio, or less, the target air-fuel ratio is set to the lean set air-fuel ratio, until the oxygen storage amount of the upstream side catalyst becomes a given storage amount which is smaller than the maximum oxygen storage amount. On the other hand, when the oxygen storage amount of the upstream side catalyst becomes the given storage amount or more, the target air-fuel ratio is set to the weak rich set air-fuel ratio.

By performing such control, if the target air-fuel ratio is set to the weak rich set air-fuel ratio, the oxygen storage amount of the upstream side catalyst gradually becomes smaller. Finally, unburned gas flows out from the upstream side catalyst, while it flows slightly. If unburned gas slightly flows out in this way, the downstream side air-fuel ratio sensor detects the reference air-fuel ratio or less and, as a result, the target air-fuel ratio is switched to a lean set air-fuel ratio.

If the target air-fuel ratio is switched to the lean set air-fuel ratio, the oxygen storage amount of the upstream side catalyst rapidly increases. If the oxygen storage amount of the upstream side catalyst rapidly increases, the oxygen storage amount reaches the given storage amount in a short time period, and then the target air-fuel ratio is switched to the weak rich set air-fuel ratio.

When performing such control, unburned gas sometimes flows out from the upstream side catalyst, but almost no $NO_X$ flows out. For this reason, basically, no $NO_X$ flows into the downstream side catalyst. Only unburned gas flows into the downstream side catalyst. In particular, in an internal combustion engine which performs fuel cut control which makes fuel injectors temporarily stop injecting fuel, when performing fuel cut control, the oxygen storage amount of the downstream side catalyst reaches the maximum oxygen storage amount. For this reason, in such an internal combustion engine, even if unburned gas flows into the downstream side catalyst, the unburned gas can be purified by releasing oxygen stored in the downstream side catalyst.

However, depending on the operating state of the vehicle mounting the internal combustion engine, sometimes fuel cut control will not be performed for a long time period. In such a case, the oxygen storage amount of the downstream side catalyst decreases, and unburned gas which slightly flows out from the upstream side catalyst may be unable to be sufficiently purified.

Therefore, in consideration of the above problem, an object of the present invention is to provide a control system of an internal combustion engine which reliably suppresses the flow-out of unburned gas from a downstream side catalyst, when controlling the air-fuel ratio of the exhaust gas flowing into an upstream side catalyst as explained above.

Solution to Problem

To solve the above problem, in a first aspect of the invention, there is provided a control system of an internal combustion engine, the engine comprising an upstream side catalyst which is provided in an exhaust passage of the internal combustion engine, and a downstream side catalyst which is provided in the exhaust passage at a downstream side, in the direction of flow of exhaust, from the upstream side catalyst, the control system comprising: a downstream side air-fuel ratio detecting means which is provide in the exhaust passage between the upstream side catalyst and the downstream side catalyst; a storage amount estimating means for estimating an oxygen storage amount of the downstream side catalyst; an inflow air-fuel ratio control device which controls an air-fuel ratio of exhaust gas flowing into the upstream side catalyst so that the air-fuel ratio of the exhaust gas becomes a target air-fuel ratio; a normal period lean control means for setting the target air-fuel ratio of exhaust gas flowing into the upstream side catalyst continuously or intermittently to leaner than a stoichiometric air-fuel ratio, when an air-fuel ratio detected by the downstream side air-fuel ratio detecting means becomes a rich judged air-fuel ratio, which is richer than the stoichiometric air-fuel ratio, or less, until the oxygen storage amount of the upstream side catalyst becomes a given upstream side judged reference storage amount smaller than a maximum oxygen storage amount; a normal period rich control means for setting the target air-fuel ratio continuously or intermittently to richer than a stoichiometric air-fuel ratio, when the oxygen storage amount of the upstream side catalyst becomes the upstream side judged reference storage amount or more so that the oxygen storage amount decreases toward zero without reaching the maximum oxygen storage amount; and a storage amount recovery control means for setting the target air-fuel ratio continuously or intermittently to leaner than the stoichiometric air-fuel ratio, when the oxygen storage amount of the downstream side catalyst which was estimated by the storage amount estimating means becomes a given downstream side lower limit storage amount, which is smaller than the maximum storage amount, or less, so that the air-fuel ratio of the exhaust gas flowing out from the upstream side catalyst never becomes richer than the stoichiometric air-fuel ratio but continuously or intermittently becomes leaner than the stoichiometric air-fuel ratio, without setting the target air-fuel ratio by the normal period rich control means and normal period lean control means.

In a second aspect of the invention, there is provided the first aspect of the invention, wherein the storage amount recovery control means continues to set the target air-fuel ratio until the oxygen storage amount of the downstream side catalyst becomes a given downstream side upper limit storage amount which is greater than the downstream side lower limit storage amount and which is less than the maximum oxygen storage amount.

In a third aspect of the invention, there is provided the first or second aspect of the invention, wherein the storage amount recovery control means intermittently sets the target air-fuel ratio leaner than the stoichiometric air-fuel ratio so that the air-fuel ratio of the exhaust gas flowing out from the upstream side catalyst intermittently becomes leaner than the stoichiometric air-fuel ratio.

In a fourth aspect of the invention, there is provided the third aspects of the invention, wherein the storage amount recovery control means comprises: recovery period rich control means for continuously or intermittently setting the target air-fuel ratio richer than the stoichiometric air-fuel ratio, when the air-fuel ratio detected by the downstream side air-fuel ratio detecting means becomes a lean judged air-fuel ratio, which is leaner than the stoichiometric air-fuel ratio, or more, until the oxygen storage amount of the upstream side catalyst becomes a given upstream side lower limit storage amount which is greater than zero; and a recovery period lean control means for continuously or intermittently setting the target air-fuel ratio to lean when the oxygen storage amount of the upstream side catalyst becomes the upstream side lower limit storage amount or less, so that the oxygen storage amount increases toward the maximum oxygen storage amount without reaching zero.

In a fifth aspect of the invention, there is provided the fourth aspect of the invention, wherein a difference between a time average value of the target air-fuel ratio and stoichiometric air-fuel ratio when continuously or intermittently sets the target air-fuel ratio is continuously or intermittently set richer than the stoichiometric air-fuel ratio by the recovery rich control means, is larger than a difference between a time average value of the target air-fuel ratio and stoichiometric air-fuel ratio when the target air-fuel ratio is continuously or intermittently set leaner than the stoichiometric air-fuel ratio by the recovery lean control means.

In a sixth aspect of the invention, there is provided the fourth or fifth aspect of the invention, wherein the recovery period rich control means continuously sets the target air-fuel ratio richer than the stoichiometric air-fuel ratio.

In a seventh aspect of the invention, there is provided any one of the fourth to sixth aspects of the invention, wherein the recovery period lean control means continuously sets the target air-fuel ratio leaner than the stoichiometric air-fuel ratio.

In an eighth aspect of the invention, there is provided the first or second aspect of the invention, wherein the storage amount recovery control means continuously sets the target air-fuel ratio leaner than the stoichiometric air-fuel ratio.

In a ninth aspect of the invention, there is provided the eighth aspect of the invention, wherein a difference between a time average value of the target air-fuel ratio and stoichiometric air-fuel ratio when the storage amount recovery control means continuously sets the target air-fuel ratio lean is not less than a difference between a time average value of the target air-fuel ratio and stoichiometric air-fuel ratio when the normal period lean control means continuously or intermittently sets the target air-fuel ratio leaner than the stoichiometric air-fuel ratio.

In a 10th aspect of the invention, there is provided the eighth aspect of the invention, wherein a difference between a time average value of the target air-fuel ratio and stoichiometric air-fuel ratio when the storage amount recovery control means continuously sets the target air-fuel ratio lean is smaller than a difference between a time average value of the target air-fuel ratio and stoichiometric air-fuel ratio when the normal period lean control means continuously or intermittently sets the target air-fuel ratio leaner than the stoichiometric air-fuel ratio.

In an 11th aspect of the invention, there is provided any one of the eighth to 10th aspects of the invention, wherein the storage amount recovery control means fixes the target air-fuel ratio at a constant air-fuel ratio over the time period during which the storage amount recovery control means sets the target air-fuel ratio.

In an 12th aspect of the invention, there is provided any one of the eighth to 10th aspects of the invention, wherein the storage amount recovery control means makes the target air-fuel ratio fall continuously or in stages in the time period during which the storage amount recovery control means sets the target air-fuel ratio.

Advantageous Effects of Invention

According to the present invention, the flow-out of unburned gas from a downstream side catalyst can be reliably suppressed.

DESCRIPTION OF EMBODIMENTS

Figure 1:
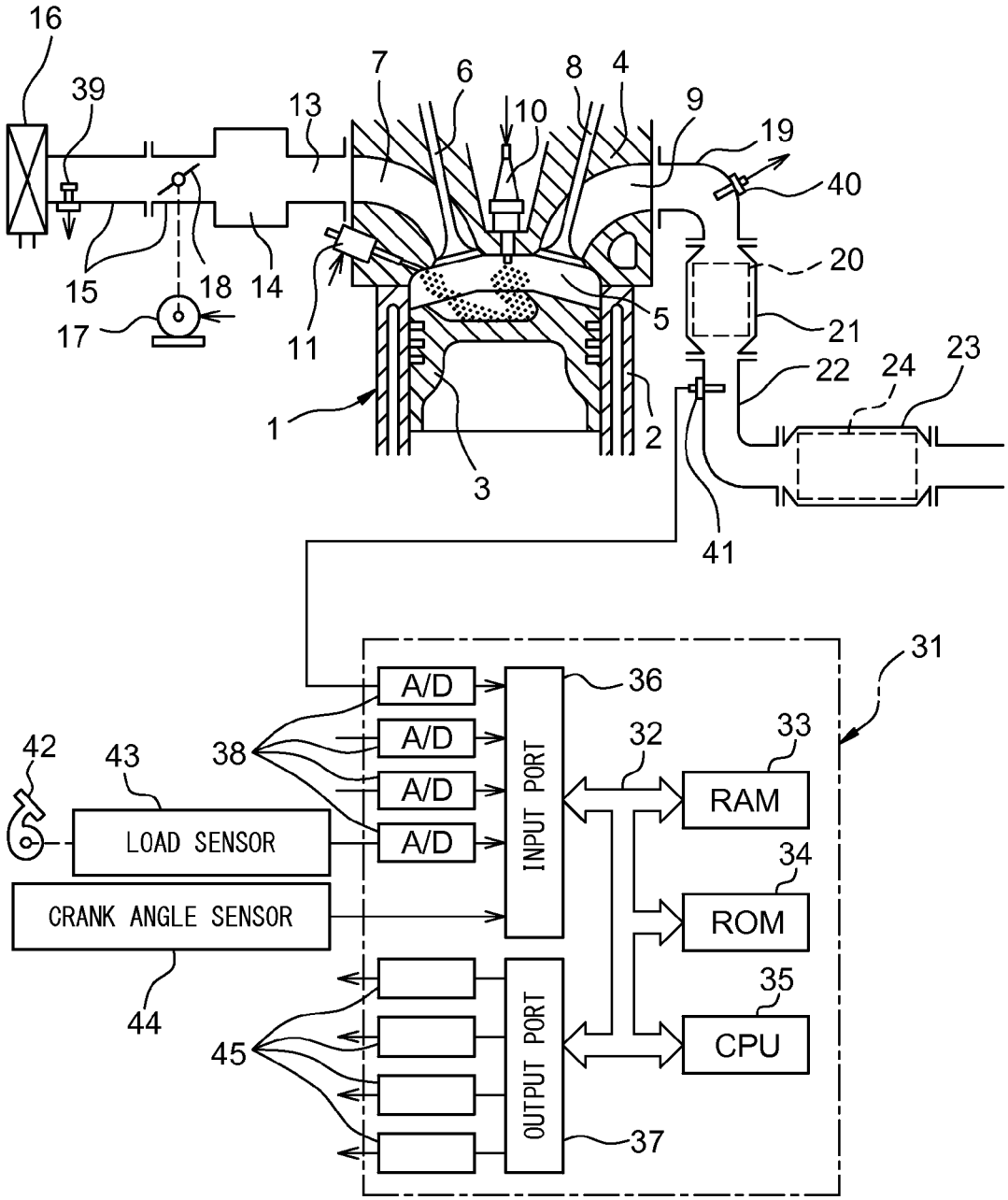
FIG. 1 is a view which schematically shows an internal combustion engine in which a control system of the present invention is used.

Below, referring to the drawings, a control device of an internal combustion engine of the present invention will be explained in detail. Note that, in the following explanation, similar component elements are assigned the same reference numerals. FIG. 1 is a view which schematically shows an internal combustion engine in which a control device according to a first embodiment of the present invention is used.

<Explanation of Internal Combustion Engine as a Whole>

Referring to FIG. 1, 1 indicates an engine body, 2 a cylinder block, 3 a piston which reciprocates inside the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, a spark plug 10 is arranged at a center part of an inside wall surface of the cylinder head 4, while a fuel injector 11 is arranged at a side part of the inner wall surface of the cylinder head 4. The spark plug 10 is configured to generate a spark in accordance with an ignition signal. Further, the fuel injector 11 injects a predetermined amount of fuel into the combustion chamber 5 in accordance with an injection signal. Note that, the fuel injector 11 may also be arranged so as to inject fuel into the intake port 7. Further, in the present embodiment, as the fuel, gasoline with a stoichiometric air-fuel ratio of 14.6 at a catalyst is used. However, the internal combustion engine of the present invention may also use another fuel.

The intake port 7 of each cylinder is connected to a surge tank 14 through a corresponding intake branch pipe 13, while the surge tank 14 is connected to an air cleaner 16 through an intake pipe 15. The intake port 7, intake branch pipe 13, surge tank 14, and intake pipe 15 form an intake passage. Further, inside the intake pipe 15, a throttle valve 18 which is driven by a throttle valve drive actuator 17 is arranged. The throttle valve 18 can be operated by the throttle valve drive actuator 17 to thereby change the aperture area of the intake passage.

On the other hand, the exhaust port 9 of each cylinder is connected to an exhaust manifold 19. The exhaust manifold 19 has a plurality of branch pipes which are connected to the exhaust ports 9 and a header at which these branch pipes are collected. The header of the exhaust manifold 19 is connected to an upstream side casing 21 which houses an upstream side catalyst 20. The upstream side casing 21 is connected through an exhaust pipe 22 to a downstream side casing 23 which houses a downstream side catalyst 24. The exhaust port 9, exhaust manifold 19, upstream side casing 21, exhaust pipe 22, and downstream side casing 23 form an exhaust passage.

The electronic control unit (ECU) 31 is comprised of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an air flow meter 39 is arranged for detecting the flow rate of air flowing through the intake pipe 15. The output of this air flow meter 39 is input through a corresponding AD converter 38 to the input port 36. Further, at the header of the exhaust manifold 19, an upstream side air-fuel ratio sensor (upstream side air-fuel ratio detecting means) 40 is arranged which detects the air-fuel ratio of the exhaust gas flowing through the inside of the exhaust manifold 19 (that is, the exhaust gas flowing into the upstream side catalyst 20). In addition, in the exhaust pipe 22, a downstream side air-fuel ratio sensor (downstream side air-fuel ratio detecting means) 41 is arranged which detects the air-fuel ratio of the exhaust gas flowing through the inside of the exhaust pipe 22 (that is, the exhaust gas flowing out from the upstream side catalyst 20 and flows into the downstream side catalyst 24). The outputs of these air-fuel ratio sensors 40 and 41 are also input through the corresponding AD converters 38 to the input port 36. Note that, the configurations of these air-fuel ratio sensors 40 and 41 will be explained later.

Further, an accelerator pedal 42 has a load sensor 43 connected to it which generates an output voltage which is proportional to the amount of depression of the accelerator pedal 42. The output voltage of the load sensor 43 is input to the input port 36 through a corresponding AD converter 38. The crank angle sensor 44 generates an output pulse every time, for example, a crankshaft rotates by 15 degrees. This output pulse is input to the input port 36. The CPU 35 calculates the engine speed from the output pulse of this crank angle sensor 44. On the other hand, the output port 37 is connected through corresponding drive circuits 45 to the spark plugs 10, fuel injectors 11, and throttle valve drive actuator 17. Note that the ECU 31 functions as control means for controlling the internal combustion engine based on the outputs of various sensors, etc.

<Explanation of Catalyst>

The upstream side catalyst 20 and the downstream side catalyst 24 both have similar configurations. Below, only the upstream side catalyst 20 will be explained, but the downstream side catalyst 24 may also have a similar configuration and action.

The upstream side catalyst 20 is a three-way catalyst which has an oxygen storage ability. Specifically, the upstream side catalyst 20 is comprised of a carrier made of ceramic on which a precious metal which has a catalytic action (for example, platinum (Pt)) and a substance which has an oxygen storage ability (for example, ceria ($CeO_2$)) are carried. If the upstream side catalyst 20 reaches a predetermined activation temperature, it exhibits an oxygen storage ability in addition to the catalytic action of simultaneously removing the unburned gas (HC, CO, etc.) and nitrogen oxides ($NO_X$).

According to the oxygen storage ability of the upstream side catalyst 20, the upstream side catalyst 20 stores the oxygen in the exhaust gas, when the air-fuel ratio of the exhaust gas flowing into the upstream side catalyst 20 is leaner than the stoichiometric air-fuel ratio (lean air-fuel ratio). On the other hand, the upstream side catalyst 20 releases the oxygen which is stored in the upstream side catalyst 20 when the air-fuel ratio of the inflowing exhaust gas is richer than the stoichiometric air-fuel ratio (rich air-fuel ratio). Note that, the "air-fuel ratio of the exhaust gas" means the ratio of the mass of the fuel to the mass of the air which are fed up to when the exhaust gas is produced. Usually, it means the ratio of the mass of the fuel to the mass of the air which are fed into the combustion chamber 5 when that exhaust gas is produced. In the present specification, sometimes the air-fuel ratio of exhaust gas is referred to as "exhaust air-fuel ratio".

The upstream side catalyst 20 has a catalytic action and an oxygen storage ability, and therefore has the action of purifying $NO_X$ and unburned gas in accordance with the oxygen storage amount. That is, as shown in FIG. 2(A), in the case where the air-fuel ratio of the exhaust gas flowing into the upstream side catalyst 20 is a lean air-fuel ratio, when the oxygen storage amount is small, the upstream side catalyst 20 stores oxygen in the exhaust gas, and reduce and purify NOx. Further, if the oxygen storage amount increases beyond a certain upper limit storage amount Cuplim, the concentration of oxygen and $NO_X$ in the exhaust gas flowing out from the upstream side catalyst 20 rapidly rises.

On the other hand, as shown in FIG. 2(B), in the case where the air-fuel ratio of the exhaust gas flowing into the upstream side catalyst 20 is a rich air-fuel ratio, when the oxygen storage amount is large, oxygen stored in the upstream side catalyst 20 is released, and unburned gas in the exhaust gas is oxidized and purified. Further, if the oxygen storage amount decreases beyond a certain lower limit storage amount Clowlim, the concentration of unburned gas in the exhaust gas flowing out from the upstream side catalyst 20 rapidly rises.

As stated above, according to the catalysts 20, 24 used in the present embodiment, the characteristic of purification of $NO_X$ and unburned gas in the exhaust gas changes in accordance with the air-fuel ratio of the exhaust gas flowing into the catalysts 20, 24 and oxygen storage amount. Note that, as long as the catalysts 20, 24 have a catalytic function and oxygen storage ability, the catalysts 20, 24 may also be catalysts which are different from three-way catalysts.

<Configuration of Air-Fuel Ratio Sensor>

Figure 3:
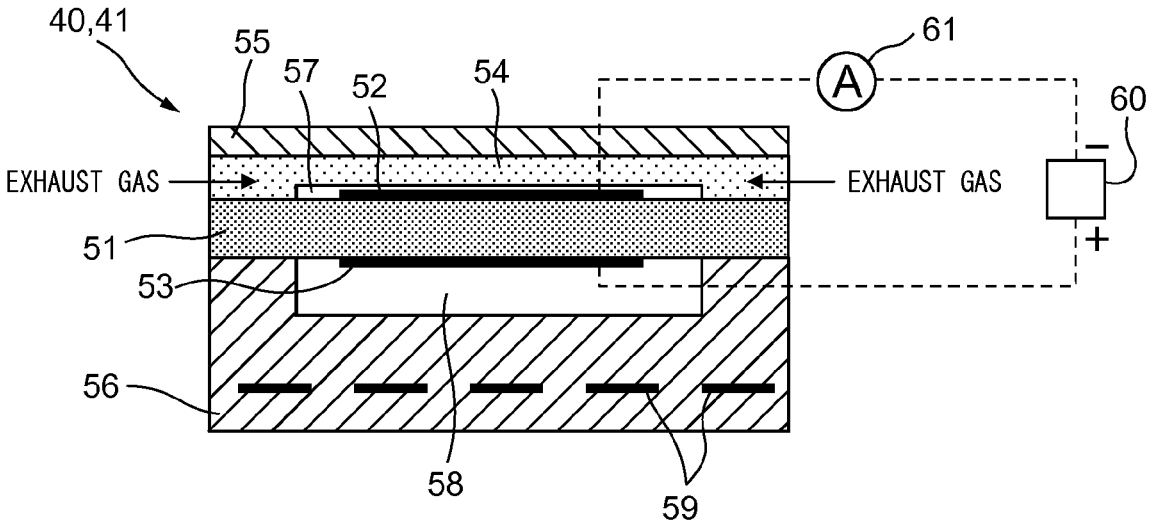
FIG. 3 is a schematic cross-sectional view of an air-fuel ratio sensor.

Next, referring to FIG. 3, the configurations of air-fuel ratio sensors 40 and 41 in the present embodiment will be explained. FIG. 3 is a schematic cross-sectional view of air-fuel ratio sensors 40 and 41. As will be understood from FIG. 3, the air-fuel ratio sensors 40 and 41 in the present embodiment are single-cell type air-fuel ratio sensors each comprised of a solid electrolyte layer and a pair of electrodes forming a single cell.

As shown in FIG. 3, each of the air-fuel ratio sensors 40 and 41 is provided with a solid electrolyte layer 51, an exhaust side electrode (first electrode) 52 which is arranged at one lateral surface of the solid electrolyte layer 51, an atmosphere side electrode (second electrode) 53 which is arranged at the other lateral surface of the solid electrolyte layer 51, a diffusion regulation layer 54 which regulates the diffusion of the passing exhaust gas, a protective layer 55 which protects the diffusion regulation layer 54, and a heater part 56 which heats the air-fuel ratio sensor 40 or 41.

On one lateral surface of the solid electrolyte layer 51, a diffusion regulation layer 54 is provided. On the lateral surface of the diffusion regulation layer 54 at the opposite side from the lateral surface of the solid electrolyte layer 51 side, a protective layer 55 is provided. In the present embodiment, a measured gas chamber 57 is formed between the solid electrolyte layer 51 and the diffusion regulation layer 54. In this measured gas chamber 57, the gas to be detected by the air-fuel ratio sensors 40 and 41, that is, the exhaust gas, is introduced through the diffusion regulation layer 54. Further, the exhaust side electrode 52 is arranged inside the measured gas chamber 57, therefore, the exhaust side electrode 52 is exposed to the exhaust gas through the diffusion regulation layer 54. Note that, the measured gas chamber 57 does not necessarily have to be provided. The diffusion regulation layer 54 may directly contact the surface of the exhaust side electrode 52.

On the other lateral surface of the solid electrolyte layer 51, the heater part 56 is provided. Between the solid electrolyte layer 51 and the heater part 56, a reference gas chamber 58 is formed. Inside this reference gas chamber 58, a reference gas is introduced. In the present embodiment, the reference gas chamber 58 is open to the atmosphere. Therefore, inside the reference gas chamber 58, the atmosphere is introduced as the reference gas. The atmosphere side electrode 53 is arranged inside the reference gas chamber 58, therefore, the atmosphere side electrode 53 is exposed to the reference gas (reference atmosphere).). In the present embodiment, atmospheric air is used as the reference gas, so the atmosphere side electrode 53 is exposed to the atmosphere.

The heater part 56 is provided with a plurality of heaters 59. These heaters 59 can be used to control the temperature of the air-fuel ratio sensor 40 or 41, in particular, the temperature of the solid electrolyte layers 51. The heater part 56 has a sufficient heat generation capacity for heating the solid electrolyte layer 51 until activating.

The solid electrolyte layer 51 is formed by a sintered body of $ZrO_2$ (zirconia), $HfO_2$, $ThO_2$, $Bi_2O_2$, or other oxygen ion conducting oxide in which CaO, MgO, $Y_2O_3$, $Yb_2O_2$, etc. is blended as a stabilizer. Further, the diffusion regulation layer 54 is formed by a porous sintered body of alumina, magnesia, silica, spinel, mullite, or another heat resistant inorganic substance. Furthermore, the exhaust side electrode 52 and atmosphere side electrode 53 is formed by platinum or other precious metal with a high catalytic activity.

Further, between the exhaust side electrode 52 and the atmosphere side electrode 53, sensor voltage Vr is supplied by the voltage supply device 60 which is mounted on the ECU 31. In addition, the ECU 31 is provided with a current detection device 61 which detects the current (output current) which flows between these electrodes 52 and 53 through the solid electrolyte layer 51 when the voltage supply device 60 supplies the sensor voltage Vr. The current which is detected by this current detection device 61 is the output current of the air-fuel ratio sensors 40 and 41.

<Operation of Air-Fuel Ratio Sensor>

Figure 4:
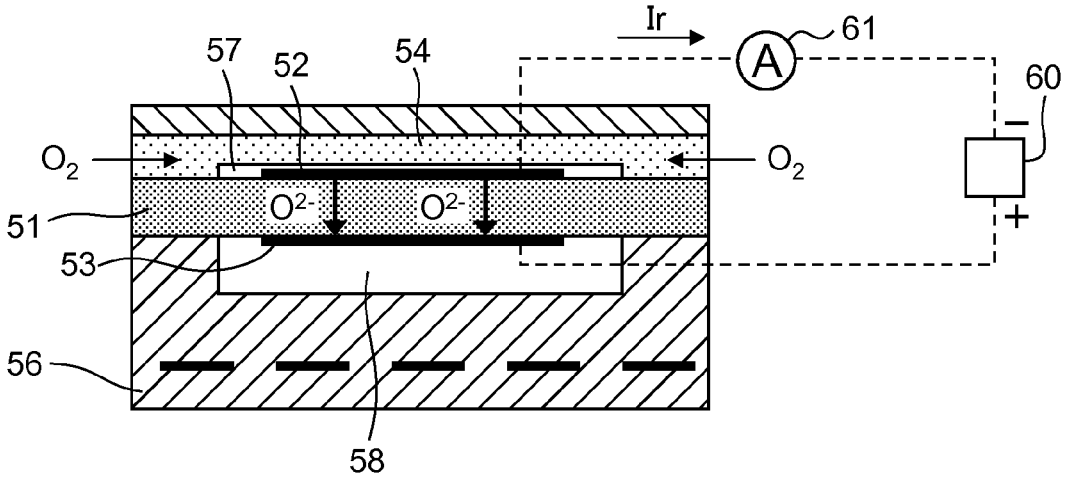
FIG. 4 is a view which schematically shows an operation of an air-fuel ratio sensor.
Figure 4:
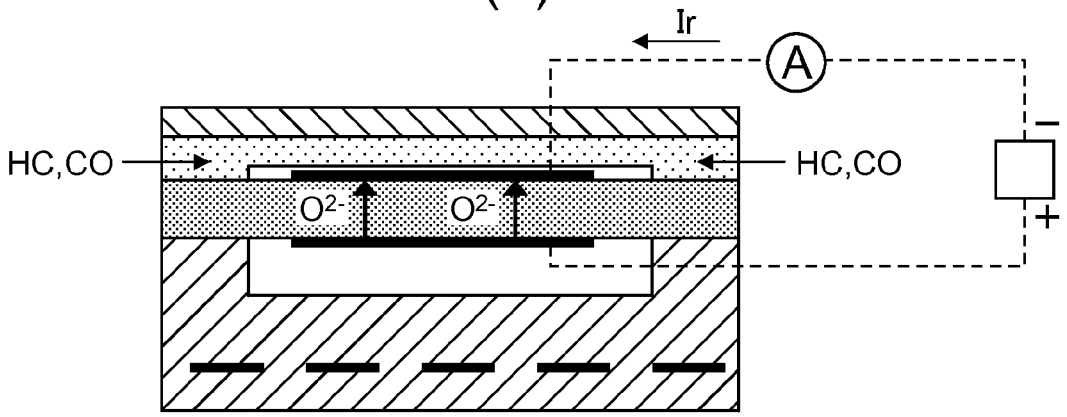
Figure 4:
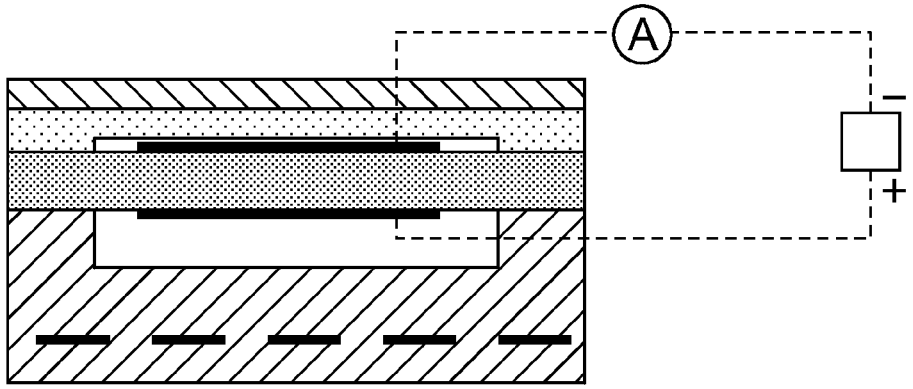

Next, referring to FIG. 4, the basic concept of the operation of the thus configured air-fuel ratio sensors 40, 41 will be explained. FIG. 4 is a view which schematically shows the operation of the air-fuel ratio sensors 40, 41. At the time of use, each of the air-fuel ratio sensors 40, 41 is arranged so that the protection layer 55 and the outer circumferential surface of the diffusion regulating layer 54 are exposed to the exhaust gas. Further, atmospheric air is introduced into the reference gas chamber 58 of the air-fuel ratio sensors 40, 41.

In the above-mentioned way, the solid electrolyte layer 51 is formed by a sintered body of an oxygen ion conductive oxide. Therefore, it has the property of an electromotive force E being generated which makes oxygen ions move from the high concentration lateral surface side to the low concentration lateral surface side if a difference occurs in the oxygen concentration between the two lateral surfaces of the solid electrolyte layer 51 in the state activated by the high temperature (oxygen cell characteristic).

Conversely, if a potential difference occurs between the two lateral surfaces, the solid electrolyte layer 51 has the characteristic of trying to make the oxygen ions move so that a ratio of oxygen concentration occurs between the two lateral surfaces of the solid electrolyte layer in accordance with the potential difference (oxygen pump characteristic). Specifically, when a potential difference occurs across the two lateral surfaces, movement of oxygen ions is caused so that the oxygen concentration at the lateral surface which has a positive polarity becomes higher than the oxygen concentration at the lateral surface which has a negative polarity, by a ratio according to the potential difference. Further, as shown in FIGS. 3 and 4, in the air-fuel ratio sensors 40, 41, a constant sensor applied voltage Vr is applied across electrodes 52, 53 so that the atmosphere side electrode 53 becomes the positive electrode and the exhaust side electrode 52 becomes the negative electrode. Note that, in the parent embodiment, the sensor applied voltages Vr in the air-fuel ratio sensors 40 and 41 are the same voltage as each other.

When the exhaust air-fuel ratio around the air-fuel ratio sensors 40, 41 is leaner than the stoichiometric air-fuel ratio, the ratio of the oxygen concentrations between the two lateral surfaces of the solid electrolyte layer 51 does not become that large. Therefore, if setting the sensor applied voltage Vr at a suitable value, between the two lateral surfaces of the solid electrolyte layer 51, the actual oxygen concentration ratio becomes smaller than the oxygen concentration ratio corresponding to the sensor applied voltage Vr. For this reason, the oxygen ions move from the exhaust side electrode 52 toward the atmosphere side electrode 43 as shown in FIG. 4(A) so that the oxygen concentration ratio between the two lateral surfaces of the solid electrolyte layer 51 becomes larger toward the oxygen concentration ratio corresponding to the sensor applied voltage Vr. As a result, current flows from the positive side of the voltage application device 60 which applies the sensor applied voltage Vr, through the atmosphere side electrode 53, solid electrolyte layer 51, and exhaust side electrode 52, to the negative side of the voltage application device 60.

The magnitude of the current (output current) Ir flowing at this time is proportional to the amount of oxygen flowing by diffusing from the exhaust through the diffusion regulating layer 54 to the measured gas chamber 57, if setting the sensor applied voltage Vr to a suitable value. Therefore, by detecting the magnitude of this current Ir by the current detection device 61, it is possible to learn the oxygen concentration and in turn possible to learn the air-fuel ratio in the lean region.

On the other hand, when the exhaust air-fuel ratio around the air-fuel ratio sensors 40, 41 is richer than the stoichiometric air-fuel ratio, unburned gas flows in from the exhaust through the diffusion regulating layer 54 to the inside of the measured gas chamber 57, and therefore even if there is oxygen present on the exhaust side electrode 52, oxygen reacts with the unburned gas and is removed. Therefore, inside the measured gas chamber 57, the oxygen concentration becomes extremely low. As a result, the ratio of the oxygen concentration between the two lateral surfaces of the solid electrolyte layer 51 becomes large. For this reason, if setting the sensor applied voltage Vr to a suitable value, between the two lateral surfaces of the solid electrolyte layer 51, the actual oxygen concentration ratio will become larger than the oxygen concentration ratio corresponding to the sensor applied voltage Vr. Therefore, as shown in FIG. 4(B), oxygen ions move from the atmosphere side electrode 53 toward the exhaust side electrode 52 so that the oxygen concentration ratio between the two lateral surfaces of the solid electrolyte layer 51 becomes smaller toward the oxygen concentration ratio corresponding to the sensor applied voltage Vr. As a result, current flows from the atmosphere side electrode 53, through the voltage application device 60 which applies the sensor applied voltage Vr, to the exhaust side electrode 52.

The magnitude of the current (output current) Ir flowing at this time is determined by the flow rate of oxygen ions which move through the solid electrolyte layer 51 from the atmosphere side electrode 53 to the exhaust side electrode 52, if setting the sensor applied voltage Vr to a suitable value. The oxygen ions react (burn) with the unburned gas, which diffuses from the exhaust through the diffusion regulating layer 54 to the measured gas chamber 57, on the exhaust side electrode 52. Accordingly, the flow rate in movement of the oxygen ions corresponds to the concentration of unburned gas in the exhaust gas flowing into the measured gas chamber 57. Therefore, by detecting the magnitude of this current Ir by the current detection device 61, it is possible to learn the concentration of unburned gas and in turn possible to learn the air-fuel ratio in the rich region.

Further, when the exhaust air-fuel ratio around the air-fuel ratio sensors 40, 41 is the stoichiometric air-fuel ratio, the amounts of oxygen and unburned gas which flow into the measured gas chamber 57 become a chemical equivalent ratio. Therefore, due to the catalytic action of the exhaust side electrode 52, oxygen and unburned gas completely burn and no fluctuation arises in the concentrations of oxygen and unburned gas in the measured gas chamber 57. As a result, the oxygen concentration ratio across the two lateral surfaces of the solid electrolyte layer 51 does not fluctuate, but is maintained at the oxygen concentration ratio corresponding to the sensor applied voltage Vr. For this reason, as shown in FIG. 4(C), no movement of oxygen ions occurs due to the oxygen pump characteristic. As a result, no current flows through the circuits.

Figure 5:
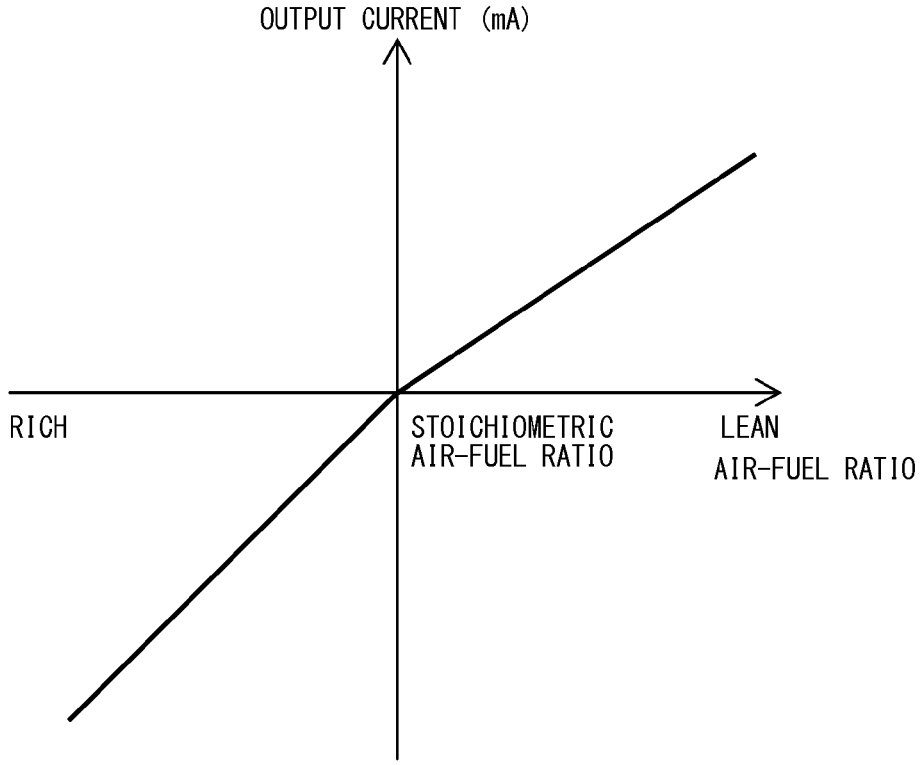
FIG. 5 is a view which shows the relationship between the exhaust air-fuel ratio and output current, of an air-fuel ratio sensor.

The thus configured air-fuel ratio sensors 40, 41 have the output characteristic shown in FIG. 5. That is, in air-fuel ratio sensors 40, 41, the larger the exhaust air-fuel ratio (that is, the leaner it becomes), the larger the output current Ir of the air-fuel ratio sensors 40, 41. In addition, the air-fuel ratio sensors 40, 41 are configured so that the output current Ir becomes zero when the exhaust air-fuel ratio is the stoichiometric air-fuel ratio.

<Circuits of Voltage Application Device and Current Detection Device>

Figure 6:
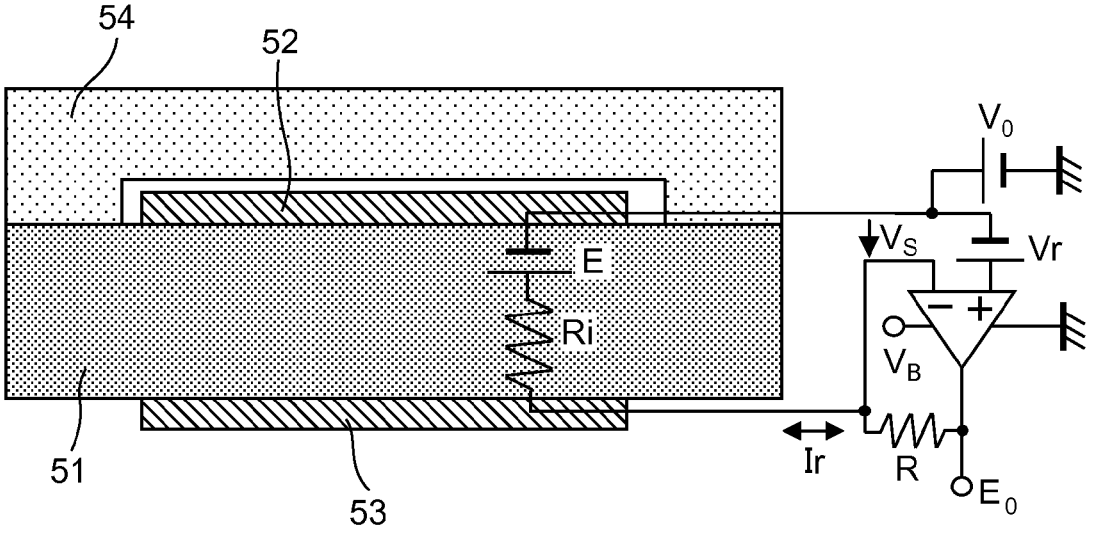
FIG. 6 is a view which shows an example of a specific circuit which forms a voltage application device and current detection device.

FIG. 6 shows an example of the specific circuits which form the voltage application device 60 and current detection device 61. In the illustrated example, the electromotive force E which occurs due to the oxygen cell characteristic is expressed as "E", the internal resistance of the solid electrolyte layer 51 is expressed as "Ri", and the difference of electrical potential across the two electrodes 52, 53 is expressed as "Vs".

As will be understood from FIG. 6, the voltage application device 60 basically performs negative feedback control so that the electromotive force E which occurs due to the oxygen cell characteristic matches the sensor applied voltage Vr. In other words, the voltage application device 60 performs negative feedback control so that even when a change in the oxygen concentration ratio between the two lateral surfaces of the solid electrode layer 51 causes the potential difference Vs between the two electrodes 52 and 53 to change, this potential difference Vs becomes the sensor applied voltage Vr.

Therefore, when the exhaust air-fuel ratio becomes the stoichiometric air-fuel ratio and no change occurs in the oxygen concentration ratio between the two lateral surfaces of the solid electrolyte layer 51, the oxygen concentration ratio between the two lateral surfaces of the solid electrolyte layer 51 becomes the oxygen concentration ratio corresponding to the sensor applied voltage Vr. In this case, the electromotive force E conforms to the sensor applied voltage Vr, the potential difference Vs between the two electrodes 52 and 53 also becomes the sensor applied voltage Vr, and, as a result, the current Ir does not flow.

On the other hand, when the exhaust air-fuel ratio becomes an air-fuel ratio which is different from the stoichiometric air-fuel ratio and a change occurs in the oxygen concentration ratio between the two lateral surfaces of the solid electrolyte layer 51, the oxygen concentration ratio between the two lateral surfaces of the solid electrolyte layer 51 does not become an oxygen concentration ratio corresponding to the sensor applied voltage Vr. In this case, the electromotive force E becomes a value different from the sensor applied voltage Vr. As a result, due to negative feedback control, a potential difference Vs is applied between the two electrodes 52 and 53 so that oxygen ions move between the two lateral surfaces of the solid electrolyte layer 51 so that the electromotive force E conforms to the sensor applied voltage Vr. Further, current Ir flows along with movement of oxygen ions at this time. As a result, the electromotive force E converges to the sensor applied voltage Vr. If the electromotive force E converges to the sensor applied voltage Vr, finally the potential difference Vs also converges to the sensor applied voltage Vr.

Therefore, the voltage application device 60 can be said to substantially apply the sensor applied voltage Vr between the two electrodes 52 and 53. Note that, the electrical circuit of the voltage application device 60 does not have to be one such as shown in FIG. 6. The circuit may be any form of device so long as able to substantially apply the sensor applied voltage Vr across the two electrodes 52, 53.

Further, the current detection device 61 does not actually detect the current. It detects the voltage $E_0$ to calculate the current from this voltage $E_0$. In this regard, $E_0$ is expressed as in the following equation (1).

$$E_0=Vr+V_0+I_rR \quad (1)$$

wherein, $V_0$ is the offset voltage (voltage applied so that $E_0$ does not become a negative value, for example, 3V), while R is the value of the resistance shown in FIG. 6.

In equation (1), the sensor applied voltage Vr, offset voltage $V_0$, and resistance value R are constant, and therefore the voltage $E_0$ changes in accordance with the current Ir. For this reason, if detecting the voltage $E_0$, it is possible to calculate the current Ir from that voltage $E_0$.

Therefore, the current detection device 61 can be said to substantially detect the current Ir which flows across the two electrodes 52, 53. Note that, the electrical circuit of the current detection device 61 does not have to be one such as shown in FIG. 6. If possible to detect the current Ir flowing across the two electrodes 52, 53, any form of device may be used.

<Summary of Air-Fuel Ratio Control>

Next, air-fuel ratio control in the control system of an internal combustion engine of the present invention will be explained in summary. In the present embodiment, feedback control is performed, based on the output current Irup of the upstream side air-fuel ratio sensor 40, so that the output current Irup of the upstream side air-fuel ratio sensor 40 (that is, the air-fuel ratio of the exhaust gas flowing into the upstream side catalyst 20) becomes a value which corresponds to the target air-fuel ratio. The control for setting the target air-fuel ratio can be roughly broken down into the two controls: normal control in the case where there is a sufficient oxygen storage amount at the downstream side catalyst 24; and storage amount recovery control where the oxygen storage amount of the downstream side catalyst 24 has fallen. Below, first, normal control will be explained.

<Summary of Normal Control>

When performing the normal control, the target air-fuel ratio is set based on the output current of the downstream side air-fuel ratio sensor 41. Specifically, the target air-fuel ratio is set to the lean set air-fuel ratio when the output current Irdwn of the downstream side air-fuel ratio sensor 41 becomes a rich judged reference value Irefri or less and is maintained at that air-fuel ratio. In this regard, the rich judged reference value Irefri is a value corresponding to a predetermined rich judged air-fuel ratio (for example, 14.55) which is slightly richer than the stoichiometric air-fuel ratio. Further, the lean set air-fuel ratio is a predetermined air-fuel ratio leaner than the stoichiometric air-fuel ratio by a certain extent. For example, it is 14.65 to 20, preferably 14.68 to 18, more preferably 14.7 to 16 or so.

If the target air-fuel ratio is changed to the lean set air-fuel ratio, the oxygen storage amount OSAsc of the upstream side catalyst 20 is estimated. The oxygen storage amount OSAsc is estimated based on the output current Irup of the upstream side air-fuel ratio sensor 40, and the estimated value of the amount of intake air to the combustion chamber 5, which is calculated based on the air flow meter 39, etc., or the amount of fuel injection from the fuel injector 11, etc. Further, if the estimated value of the oxygen storage amount OSAsc of the upstream side catalyst 20 becomes a predetermined upstream side judged reference storage amount Chiup or more, the target air-fuel ratio which was the lean set air-fuel ratio up to then is changed to a weak rich set air-fuel ratio and is maintained at that air-fuel ratio. The weak rich set air-fuel ratio is a predetermined air-fuel ratio slightly richer than the stoichiometric air-fuel ratio. For example, it is 13.5 to 14.58, preferably 14 to 14.57, more preferably 14.3 to 14.55 or so. After that, when the output current Irdwn of the downstream side air-fuel ratio sensor 41 again becomes the rich judged reference value Irefri or less, the target air-fuel ratio of the exhaust gas flowing into the upstream side catalyst 20 is again set to the lean set air-fuel ratio, and then a similar operation is repeated.

In this way, in the present embodiment, the target air-fuel ratio of the exhaust gas flowing into the upstream side catalyst 20 is alternately set to the lean set air-fuel ratio and the weak rich set air-fuel ratio. In particular, in the present embodiment, the difference between the lean set air-fuel ratio and the stoichiometric air-fuel ratio is larger than the difference between the weak rich set air-fuel ratio and the stoichiometric air-fuel ratio. Therefore, in the present embodiment, the target air-fuel ratio is alternately set to lean set air-fuel ratio for a short period of time and weak rich set air-fuel ratio for a long period of time.

<Explanation of Normal Control Using Time Chart>

Figure 7:
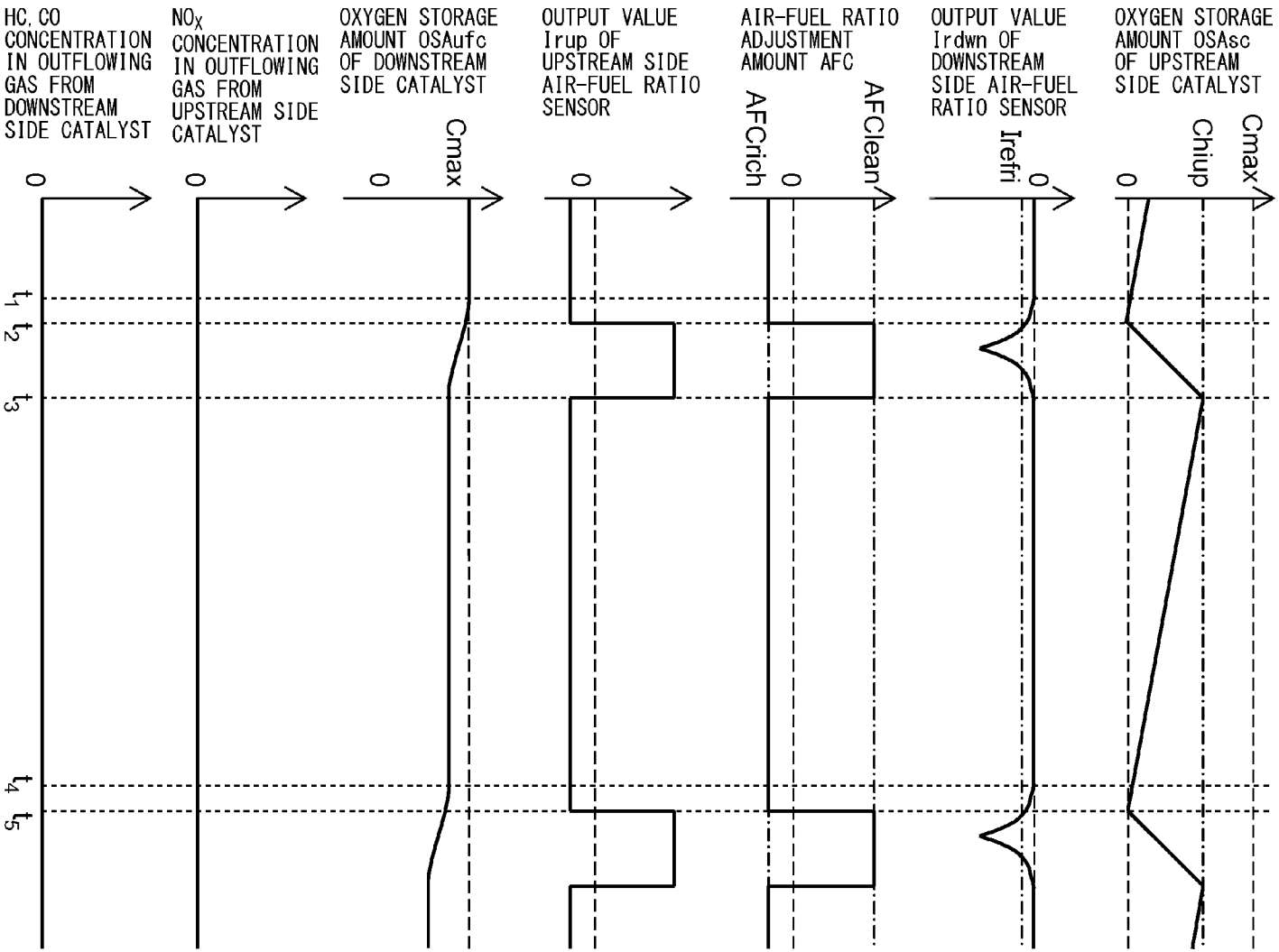
FIG. 7 is a time chart of the oxygen storage amount of the catalyst, etc.

Referring to FIG. 7, the above-mentioned such operation will be explained in detail. FIG. 7 is a time chart of the oxygen storage amount OSAsc of the upstream side catalyst 20, the output current Irdwn of the downstream side air-fuel ratio sensor 41, the air-fuel ratio adjustment amount AFC, the output current Irup of the upstream side air-fuel ratio sensor 40, the oxygen storage amount OSAufc of the downstream side catalyst 24, NOx concentration of the exhaust gas flowing out from the upstream side catalyst 20, and unburned gas (HC, CO, etc.) flowing out from the downstream side catalyst 24, in the case of performing air-fuel ratio control in a control system of an internal combustion engine of the present invention.

Note that, the output current Irup of the upstream side air-fuel ratio sensor 40 becomes zero when the air-fuel ratio of the exhaust gas flowing into the upstream side catalyst 20 is the stoichiometric air-fuel ratio, becomes a negative value when the air-fuel ratio of the exhaust gas is a rich air-fuel ratio, and becomes a positive value when the air-fuel ratio of the exhaust gas is a lean air-fuel ratio. Further, when the air-fuel ratio of the exhaust gas flowing into the upstream side catalyst 20 is a rich air-fuel ratio or lean air-fuel ratio, the greater the difference from the stoichiometric air-fuel ratio, the larger the absolute value of the output current Irup of the upstream side air-fuel ratio sensor 40.

The output current Irdwn of the downstream side air-fuel sensor 41 also changes, depending on the air-fuel ratio of the exhaust gas flowing out from the upstream side catalyst 20, similarly to the output current Irup of the upstream side air-fuel ratio sensor 40. Further, the air-fuel ratio adjustment amount AFC of the exhaust gas flowing into the upstream side catalyst 20 is a adjustment amount relating to the target air-fuel ratio. When the air-fuel ratio adjustment amount AFC is 0, the target air-fuel ratio is the stoichiometric air-fuel ratio, when the air-fuel ratio adjustment amount AFC is a positive value, the target air-fuel ratio becomes a lean air-fuel ratio, and when the air-fuel ratio adjustment amount AFC is a negative value, the target air-fuel ratio becomes a rich air-fuel ratio.

In the illustrated example, in the state before the time $t_1$, the air-fuel ratio adjustment amount AFC is set to the weak rich set adjustment amount AFCrich. The weak rich set adjustment amount AFCrich is a value corresponding to the weak rich set air-fuel ratio and a value smaller than 0. Therefore, the target air-fuel ratio of the exhaust gas flowing into the upstream side catalyst 20 is set to a rich air-fuel ratio. Along with this, the output current Irup of the upstream side air-fuel ratio sensor 40 becomes a negative value. The exhaust gas flowing into the upstream side catalyst 20 contains unburned gas, and therefore the oxygen storage amount OSAsc of the upstream side catalyst 20 gradually decreases. However, the unburned gas contained in the exhaust gas flowing into the upstream side catalyst 20 is purified at the upstream side catalyst 20, and therefore the output current Irdwn of the downstream side air-fuel ratio sensor becomes substantially 0 (corresponding to the stoichiometric air-fuel ratio). At this time, the air-fuel ratio of the exhaust gas flowing into the upstream side catalyst 20 becomes a rich air-fuel ratio, and therefore the amount of $NO_X$ exhausted from the upstream side catalyst 20 is suppressed.

If the oxygen storage amount OSAsc of the upstream side catalyst 20 gradually decreases, the oxygen storage amount OSAsc decreases to less than the lower limit storage amount (see Clowlim of FIG. 2) at the time $t_1$. If the oxygen storage amount OSAsc decreases to less than the lower limit storage amount, part of the unburned gas flowing into the upstream side catalyst 20 flows out without being purified at the upstream side catalyst 20. For this reason, after the time $t_1$, the output current Irdwn of the downstream side air-fuel ratio sensor 41 gradually falls along with the decrease in the oxygen storage amount OSAsc of the upstream side catalyst 20. At this time as well, the air-fuel ratio of the exhaust gas flowing into the upstream side catalyst 20 becomes a rich air-fuel ratio, and therefore the amount of $NO_X$ exhausted from the upstream side catalyst 20 is suppressed.

Then, at the time $t_2$, the output current Irdwn of the downstream side air-fuel ratio sensor 41 reaches a rich judged reference value Irefri, corresponding to the rich judged air-fuel ratio. In the present embodiment, if the output current Irdwn of the downstream side air-fuel ratio sensor 41 reaches the rich judged reference value Irefri, the air-fuel ratio adjustment amount AFC is switched to the lean set adjustment amount AFClean so as to suppress the decrease of the oxygen storage amount OSAsc of the upstream side catalyst 20. The lean set adjustment amount AFClean is a value corresponding to the lean set air-fuel ratio and is a value larger than 0. Therefore, the target air-fuel ratio is set to a lean air-fuel ratio.

Note that, in the present embodiment, the air-fuel ratio adjustment amount AFC is switched after the output current Irdwn of the downstream side air-fuel ratio sensor 41 reaches the rich judged reference value Irefri, that is, after the air-fuel ratio of the exhaust gas flowing out from the upstream side catalyst 20 reaches the rich judged air-fuel ratio. This is because even if the oxygen storage amount of the upstream side catalyst 20 is sufficient, the air-fuel ratio of the exhaust gas flowing out from the upstream side catalyst 20 sometimes deviates slightly from the stoichiometric air-fuel ratio. That is, if it is judged that the oxygen storage amount of the upstream side catalyst 20 has decreased to less than the lower limit storage amount when the output current Irdwn deviates slightly from zero (corresponding to the stoichiometric air-fuel ratio), even if there is actually a sufficient oxygen storage amount, there is a possibility that it is judged that the oxygen storage amount decreases to lower than the lower limit storage amount. Therefore, in the present embodiment, it is judged the oxygen storage amount decreases lower than the lower limit storage amount, only when the air-fuel ratio of the exhaust gas flowing out from the upstream side catalyst 20 reaches the rich judged air-fuel ratio. Conversely speaking, the rich judged air-fuel ratio is set to an air-fuel ratio which the air-fuel ratio of the exhaust gas flowing out from the upstream side catalyst 20 does not reach when the oxygen storage amount of the upstream side catalyst 20 is sufficient.

At the time $t_2$, if switching the target air-fuel ratio to the lean air-fuel ratio, the air-fuel ratio of the exhaust gas flowing into the upstream side catalyst 20 also changes from the rich air-fuel ratio to the lean air-fuel ratio (in actuality, a delay occurs from when switching the target air-fuel ratio to when the air-fuel ratio of the exhaust gas flowing into the upstream side catalyst 20 changes, but in the illustrated example, it is assumed for convenience that these change simultaneously).

At the time $t_2$, if the air-fuel ratio of the exhaust gas flowing into the upstream side catalyst 20 changes to the lean air-fuel ratio, the oxygen storage amount OSAsc of the upstream side catalyst 20 increases. Further, along with this, the air-fuel ratio of the exhaust gas flowing out from the upstream side catalyst 20 changes to the stoichiometric air-fuel ratio, and the output current Irdwn of the downstream side air-fuel ratio sensor 41 also converges to zero. Note that, in the illustrated example, right after switching the target air-fuel ratio, the output current Irdwn of the downstream side air-fuel ratio sensor 41 falls. This is because a delay occurs from when switching the target air-fuel ratio to when the exhaust gas reaches the downstream side air-fuel ratio sensor 41.

Although the air-fuel ratio of the exhaust gas flowing into the upstream side catalyst 20 is a lean air-fuel ratio at this time, the upstream side catalyst 20 has sufficient leeway in the oxygen storage ability, and therefore the oxygen in the exhaust gas flowing into upstream side catalyst 20 is stored in the upstream side catalyst 20 and the $NO_X$ is reduced and purified. For this reason, the amount of $NO_X$ exhausted from the upstream side catalyst 20 is suppressed.

Then, if the oxygen storage amount OSAsc of the upstream side catalyst 20 increases, at the time $t_3$, the oxygen storage amount OSAsc reaches the upstream side judged reference storage amount Chiup. In the present embodiment, if the oxygen storage amount OSAsc becomes the upstream side judged reference storage amount Chiup, the air-fuel ratio adjustment amount AFC is switched to a weak rich set adjustment amount AFCrich (value smaller than 0) to stop the storage of oxygen in the upstream side catalyst 20. Therefore, the target air-fuel ratio is set to the rich air-fuel ratio.

Note that, as explained above, in the illustrated example, the air-fuel ratio of the exhaust gas flowing into the upstream side catalyst 20 changes at the same time as switching the target air-fuel ratio, but a delay actually occurs. For this reason, even if switching at the time $t_3$, after a certain extent of time passes from it, the air-fuel ratio of the exhaust gas flowing into the upstream side catalyst 20 changes from the lean air-fuel ratio to the rich air-fuel ratio. Therefore, the oxygen storage amount OSAsc of the upstream side catalyst 20 increases until the air-fuel ratio of the exhaust gas flowing into the upstream side catalyst 20 changes to the rich air-fuel ratio.

However, the upstream side judged reference storage amount Chiup is set sufficiently lower than the maximum oxygen storage amount Cmax or the upper limit storage amount (see Cuplim in FIG. 2), and therefore even at the time $t_3$, the oxygen storage amount OSAsc does not reach the maximum oxygen storage amount Cmax or the upper limit storage amount Cuplim. Conversely speaking, the upstream side judged reference storage amount Chiup is set to an amount sufficiently small so that the oxygen storage amount OSAsc does not reach the maximum oxygen storage amount Cmax or the upper limit storage amount even if a delay occurs from when switching the target air-fuel ratio to when the air-fuel ratio of the exhaust gas flowing into the upstream side catalyst 20 actually changes. For example, the upstream side judged reference storage amount Chiup is set to ¾ or less of the maximum oxygen storage amount Cmax, preferably ½ or less, more preferably ⅕ or less.

After the time $t_3$, the air-fuel ratio adjustment amount AFC is set to the weak rich set adjustment amount AFCrich. Therefore, the target air-fuel ratio is set to the rich air-fuel ratio. Along with this, the output current Irup of the upstream side air-fuel ratio sensor 40 becomes a negative value. The exhaust gas flowing into the upstream side catalyst 20 contains unburned gas, and therefore the oxygen storage amount OSAsc of the upstream side catalyst 20 gradually decreases. At the time $t_4$, in the same way as the time $t_1$, the oxygen storage amount OSAsc decreases below the lower limit storage amount. At this time as well, the air-fuel ratio of the exhaust gas flowing into the upstream side catalyst 20 becomes a rich air-fuel ratio, and therefore the amount of $NO_X$ exhausted from the upstream side catalyst 20 is suppressed.

Next, at the time $t_5$, in the same way as the time $t_2$, the output current Irdwn of the downstream side air-fuel ratio sensor 41 reaches the rich judged reference value Irefri corresponding to the rich judged air-fuel ratio. Due to this, the air-fuel ratio adjustment amount AFC is switched to the value AFClean corresponding to the lean set air-fuel ratio. Then, the cycle of the above-mentioned times $t_1$ to $t_4$ is repeated.

Note that such control of the air-fuel ratio adjustment amount AFC is performed by the ECU 31. Therefore, the ECU 31 can be said to comprise a normal lean control means for continuously setting a target air-fuel ratio of the exhaust gas flowing into the upstream side catalyst 20 to a lean set air-fuel ratio when the air-fuel ratio of the exhaust gas detected by the downstream side air-fuel ratio sensor 41 becomes a rich judged air-fuel ratio or less, until the oxygen storage amount OSAsc of the upstream side catalyst 20 becomes the upstream side judged reference storage amount Chiup, and a normal rich control means for continuously setting a target air-fuel ratio to a weak rich set air-fuel ratio, when the oxygen storage amount OSAsc of the upstream side catalyst 20 becomes the upstream side judged reference storage amount Chiup or more, so that the oxygen storage amount OSAsc decreases toward zero without reaching the maximum storage amount Cmax.

As will be understood from the above explanation, according to the above embodiment, it is possible to constantly make the amount of $NO_X$ exhausted from the upstream side catalyst 20 small. That is, so long as performing the above-mentioned control, basically the amount of $NO_X$ exhausted from the upstream side catalyst 20 can be made smaller.

Further, generally, when the oxygen storage amount OSAsc is estimated based on the output current Irup of the upstream side air-fuel ratio sensor 40 and the estimated value of the intake air amount, etc., error may occur. In the present embodiment as well, the oxygen storage amount OSAsc is estimated over the times $t_2$ to $t_3$, and therefore the estimated value of the oxygen storage amount OSAsc includes some error. However, even if such error is included, if setting the upstream side judged reference storage amount Chiup sufficiently lower than the maximum oxygen storage amount Cmax or the upper limit storage amount, the actual oxygen storage amount OSAsc will almost never reach the maximum oxygen storage amount Cmax or the upper limit storage amount Cuplim. Therefore, from such a viewpoint as well, it is possible to suppress the amount of discharge of $NO_X$ from the upstream side catalyst 20.

Further, if the oxygen storage amount of the catalyst is maintained constant, the oxygen storage ability of the catalyst falls. As opposed to this, according to the present embodiment, the oxygen storage amount OSAsc of the upstream side catalyst 20 constantly fluctuates up and down, and therefore the oxygen storage ability is kept from falling.

Note that, in the above embodiment, the oxygen storage amount OSAsc of the upstream side catalyst 20 is estimated based on the output current Irup of the upstream side air-fuel ratio sensor 40 and the estimated value of the intake air amount to the combustion chamber 5, etc. However, the oxygen storage amount OSAsc may also be calculated based on other parameters in addition to these parameters, or may also be estimated based on parameters different from these parameters.

Further, in the above embodiment, if the estimated value of the oxygen storage amount OSAsc becomes the upstream side judged reference storage amount Chiup or more, the target air-fuel ratio is switched from the lean set air-fuel ratio to the weak rich set air-fuel ratio. However, the timing for switching the target air-fuel ratio from the lean set air-fuel ratio to the weak rich set air-fuel ratio may be determined based on other parameters, such as, for example, the engine operating time from when switching the target air-fuel ratio from the weak rich set air-fuel ratio to the lean set air-fuel ratio. However, in this case as well, while the oxygen storage amount OSAsc of the upstream side catalyst 20 is estimated to be smaller than the maximum oxygen storage amount, the target air-fuel ratio has to be switched from the lean set air-fuel ratio to the weak rich set air-fuel ratio.

In addition, in the above embodiment, during the times $t_2$ to $t_3$, the air-fuel ratio adjustment amount AFC is maintained at the lean set adjustment amount AFClean. However, in this time period, the air-fuel ratio adjustment amount AFC does not necessarily have to be maintained constant. It may be set to vary, such as gradually decreasing. In the same way, during the times $t_3$ to $t_5$, the air-fuel ratio adjustment amount AFC is maintained at the weak rich set adjustment amount AFrich. However, in this time period, the air-fuel ratio adjustment amount AFC does not necessarily have to be maintained constant. It may be set to vary, such as gradually decreasing.

However, even in this case, the air-fuel ratio adjustment amount AFC during the times $t_2$ to $t_3$ is set so that the difference between the time average value of the target air-fuel ratio in that period (that is, an average value of the air-fuel ratio during the times $t_2$ to $t_3$) and the stoichiometric air-fuel ratio becomes larger than the difference between the time average value of the target air-fuel ratio during the times $t_3$ to $t_5$ and the stoichiometric air-fuel ratio.

In addition, even while the air-fuel ratio adjustment amount AFC is set to the weak rich set adjustment amount AFCrich, it is possible to temporarily set the air-fuel ratio adjustment amount AFC to a value which corresponds to the lean air-fuel ratio (for example, lean set adjustment amount AFClean) for a short time every certain extent of time interval. That is, even while the target air-fuel ratio of the exhaust gas flowing into the upstream side catalyst 20 is set to a weak rich set air-fuel ratio, every certain extent of time interval, the target air-fuel ratio may be set to a lean air-fuel ratio temporarily for a short time. This state is shown in FIG. 8.

Figure 8:
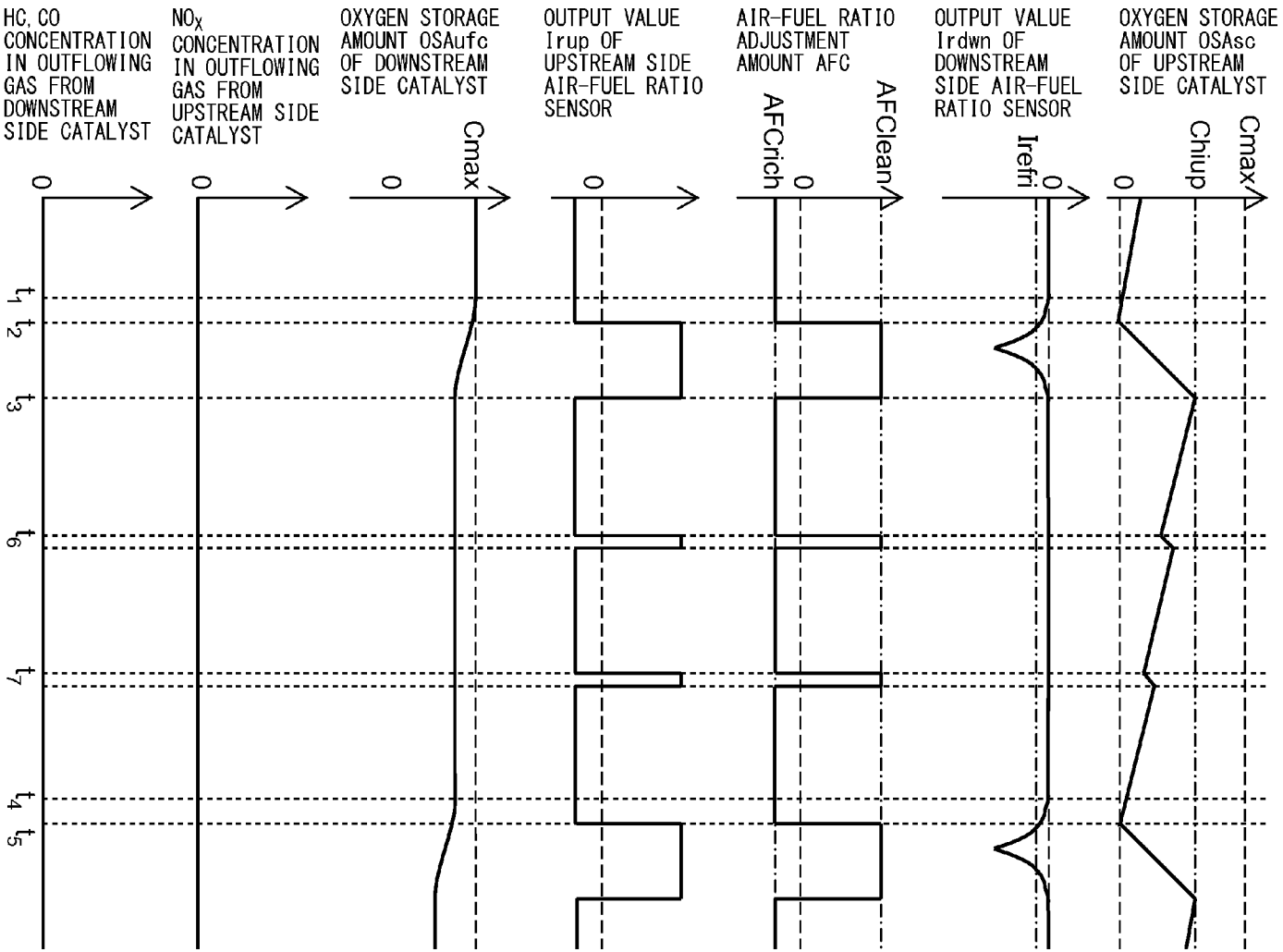
FIG. 8 is a time chart of the oxygen storage amount of the catalyst, etc.

FIG. 8 is a figure similar to FIG. 7. In FIG. 8, the times $t_1$ to $t_5$ show control timings similar to the times $t_1$ to $t_5$ in FIG. 7. Therefore, in the control shown in FIG. 8 as well, at the timings of the times $t_1$ to $t_5$, control similar to the control shown in FIG. 7 is performed. In addition, in the control shown in FIG. 8, between the times $t_3$ to $t_5$, that is, while the air-fuel ratio adjustment amount AFC is set to the weak rich set adjustment amount AFCrich, the air-fuel ratio adjustment amount AFC is temporarily set to the lean set adjustment amount AFClean several times (the times $t_6$ and $t_7$).

By temporarily increasing the air-fuel ratio of the exhaust gas flowing into the upstream side catalyst 20 in this way, it is possible to temporarily increase the oxygen storage amount OSAsc of the upstream side catalyst 20 or temporarily reduce the decrease in the oxygen storage amount OSAsc. Due to this, the time period from when, at the time $t_3$, the air-fuel ratio adjustment amount AFC is switched to the weak rich set adjustment amount AFCrich, to when, at the time $t_5$, the output current Irdwn of the downstream side air-fuel ratio sensor 41 reaches the rich judged reference value Irefri, can be longer. That is, the timing, at which the oxygen storage amount OSAsc of the upstream side catalyst 20 becomes close to zero and unburned gas flows out from the upstream side catalyst 20, can be delayed. Due to this, the amount of outflow of unburned gas from the upstream side catalyst 20 can be decreased.

Note that, in the example which is shown in FIG. 8, while the air-fuel ratio adjustment amount AFC is basically set to the weak rich set adjustment amount AFCrich (times $t_3$ to $t_5$), the air-fuel ratio adjustment amount AFC is temporarily set to the lean set adjustment amount AFClean. When temporarily changing the air-fuel ratio adjustment amount AFC in this way, it is not necessarily required to change the air-fuel ratio adjustment amount AFC to the lean set adjustment amount AFClean. As long as leaner than the weak rich set adjustment amount AFCrich, any air-fuel ratio may be changed to.

Further, even while the air-fuel ratio adjustment amount AFC is set to a basically lean set adjustment amount AFClean (times $t_2$ to $t_3$), the air-fuel ratio adjustment amount AFC may temporarily be set to the weak rich set adjustment amount AFCrich. In this case as well, similarly, when temporarily changing the air-fuel ratio adjustment amount AFC, as long as richer than the lean set adjustment amount AFClean, the air-fuel ratio adjustment amount AFC can be changed to any air-fuel ratio.

However, in the present embodiment as well, the air-fuel ratio adjustment amount AFC during the times $t_2$ to $t_3$ is set so that the difference between the time average value of the target air-fuel ratio (that is, the average value of the times $t_2$ to $t_3$) and the stoichiometric air-fuel ratio in that time period is larger than the difference between the time average value of the target air-fuel ratio during the times $t_3$ to $t_5$ and the stoichiometric air-fuel ratio.

Whatever the case, if expressing the examples of FIGS. 7 and 8 together, the ECU 31 can be said to comprise: an oxygen storage amount increasing means for continuously or intermittently setting an air-fuel ratio of exhaust gas flowing into the upstream side catalyst 20 to a lean set air-fuel ratio, when the air-fuel ratio of the exhaust gas detected by the downstream side air-fuel ratio sensor 41 becomes a rich judged air-fuel ratio or less, until the oxygen storage amount OSAsc of the upstream side catalyst 20 becomes the upstream side judged reference storage amount Chiup; and an oxygen storage amount decreasing means for continuously or intermittently setting the target air-fuel ratio to a weak rich set air-fuel ratio, when the oxygen storage amount OSAsc of the upstream side catalyst 20 becomes the upstream side judged reference storage amount Chiup or more, so that the oxygen storage amount OSAsc decreases toward zero without reaching the maximum oxygen storage amount Cmax.

<Explanation of Normal Control Using Downstream Side Catalyst>

Further, in the present embodiment, in addition to the upstream side catalyst 20, a downstream side catalyst 24 is also provided. The oxygen storage amount OSAufc of the downstream side catalyst 24 becomes a value near the maximum storage amount Cmax by fuel cut control which is performed every certain extent of time period. For this reason, even if exhaust gas containing unburned gas flows out from the upstream side catalyst 20, the unburned gas is oxidized and purified at the downstream side catalyst 24.

Note that, "fuel cut control" is control to prevent injection of fuel from the fuel injectors 11, at the time of deceleration, etc., of the vehicle which mounts the internal combustion engine, while the crankshaft or pistons 3 are in an operating state. If performing this control, a large amount of air flows into the two catalysts 20, 24.

In the example shown in FIG. 7, before the time $t_1$, fuel cut control is performed. Therefore, before the time $t_1$, the oxygen storage amount OSAufc of the downstream side catalyst 24 becomes a value near the maximum oxygen storage amount Cmax. Further, before the time $t_1$, the air-fuel ratio of the exhaust gas flowing out from the upstream side catalyst 20 is maintained at substantially the stoichiometric air-fuel ratio. Therefore, the oxygen storage amount OSAufc of the downstream side catalyst 24 is maintained constant.

After that, during the times $t_1$ to $t_3$, the air-fuel ratio of the exhaust gas flowing out from the upstream side catalyst 20 becomes the rich air-fuel ratio. For this reason, exhaust gas including unburned gas flows into the downstream side catalyst 24.

As explained above, since the downstream side catalyst 24 stores a large amount of oxygen, if the exhaust gas flowing into the upstream side catalyst 20 contains unburned gas, the unburned gas is oxidized and purified by the stored oxygen. Further, along with this, the oxygen storage amount OSAufc of the downstream side catalyst 24 decreases. However, during the times $t_1$ to $t_3$, the unburned gas flowing out from the upstream side catalyst 20 is not that great, and therefore the amount of decrease of the oxygen storage amount OSAufc at this time is slight. For this reason, during the times $t_1$ to $t_3$, the unburned gas flowing out from the upstream side catalyst 20 is completely oxidized and purified at the downstream side catalyst 24.

After the time $t_4$, at every certain extent of time interval, in the same way as the case of the times $t_1$ to $t_3$, sunburned gas flows out from the upstream side catalyst 20. The thus outflowing unburned gas is basically reduced and purified by the oxygen stored at the downstream side catalyst 24.

<Summary of Storage Amount Recovery Control>

In this regard, since fuel cut control is performed at the time of deceleration of the vehicle which mounts the internal combustion engine, etc., it is not necessarily performed at constant time intervals. Therefore, in some cases, fuel cut control will sometimes not be performed for a long time period. In such a case, if unburned gas repeatedly flows out from the upstream side catalyst 20, finally, the oxygen storage amount OSCufc of the downstream side catalyst 24 will reach zero. If the oxygen storage amount OSCufc of the downstream side catalyst 24 reaches zero, the downstream side catalyst 24 can no longer purify the unburned gas any more, and unburned gas flows out from the downstream side catalyst 24.

Therefore, in the present embodiment, the oxygen storage amount OSAufc of the downstream side catalyst 24 is estimated, based on the estimated value of the amount of intake air to the combustion chamber 4 which is calculated by the air flow meter 39, etc., or the fuel injection amount from the fuel injector 11 and output current Irdwn of the downstream side air-fuel ratio sensor 41, etc. Further, if the estimated value of the oxygen storage amount OSAufc of the downstream side catalyst 24 becomes a predetermined downstream side lower limit storage amount Clowdwn or less, normal control is stopped and storage amount recovery control is started. If storage amount recovery control is started, the setting of the target air-fuel ratio at the normal control is stopped and the target air-fuel ratio is set to a predetermined air-fuel ratio which is considerably leaner than the stoichiometric air-fuel ratio. In the present embodiment, this air-fuel ratio is set to the same air-fuel ratio as the lean set air-fuel ratio in normal control.

Note that, this air-fuel ratio does not necessarily have to be the same as the lean set air-fuel ratio in normal control, and may be leaner than the stoichiometric air-fuel ratio by a certain extent (for example, 14.65 to 20, preferably 14.68 to 18, more preferably 14.7 to 16 or so). In particular, this air-fuel ratio is preferably the lean set air-fuel ratio at normal control or more. Therefore, the difference between the time average value of the target air-fuel ratio and the stoichiometric air-fuel ratio, when continuously setting the target air-fuel ratio lean by the storage amount recovery control, is preferably not less than the difference between the time average value of the target air-fuel ratio and the stoichiometric air-fuel ratio, when continuously or intermittently setting the target air-fuel ratio leaner than the stoichiometric air-fuel ratio by the normal period lean control means.

Further, in the present embodiment, the downstream side lower limit storage amount Clowdwn is set to a value whereby even if some error occurs in the estimated value of the oxygen storage amount OSAufc of the downstream side catalyst 24, the actual oxygen storage amount OSAufc will never reach zero. For example, the downstream side lower limit storage amount Clowdwn is set to ¼ or more, preferably ½ or more, more preferably ⅘ or more, of the maximum oxygen storage amount Cmax.

If the target air-fuel ratio is changed to the lean set air-fuel ratio, the oxygen storage amount of the upstream side catalyst 20 increases and finally reaches the maximum oxygen storage amount. If maintaining the target air-fuel ratio at the lean set air-fuel ratio after that, oxygen is no longer stored by the upstream side catalyst 20, and therefore oxygen flows out from the upstream side catalyst 20. This oxygen flows into the downstream side catalyst 24. Since the oxygen storage amount OSAufc of the downstream side catalyst 24 has fallen, the downstream side catalyst 24 stores oxygen and thus the oxygen storage amount OSAufc of the downstream side catalyst 24 increases.

If continuing to set the target air-fuel ratio of the exhaust gas flowing into the upstream side catalyst 20 to the lean set air-fuel ratio after that, the estimated value of the oxygen storage amount OSAufc of the downstream side catalyst 24 becomes a predetermined downstream side upper limit storage amount Chidwn or more. In the present embodiment, if the oxygen storage amount OSAufc becomes the downstream side upper limit storage amount Chidwn or more, the storage amount recovery control is ended and normal control is resumed.

<Explanation of Storage Amount Recovery Control Using Time Chart>

Figure 9:
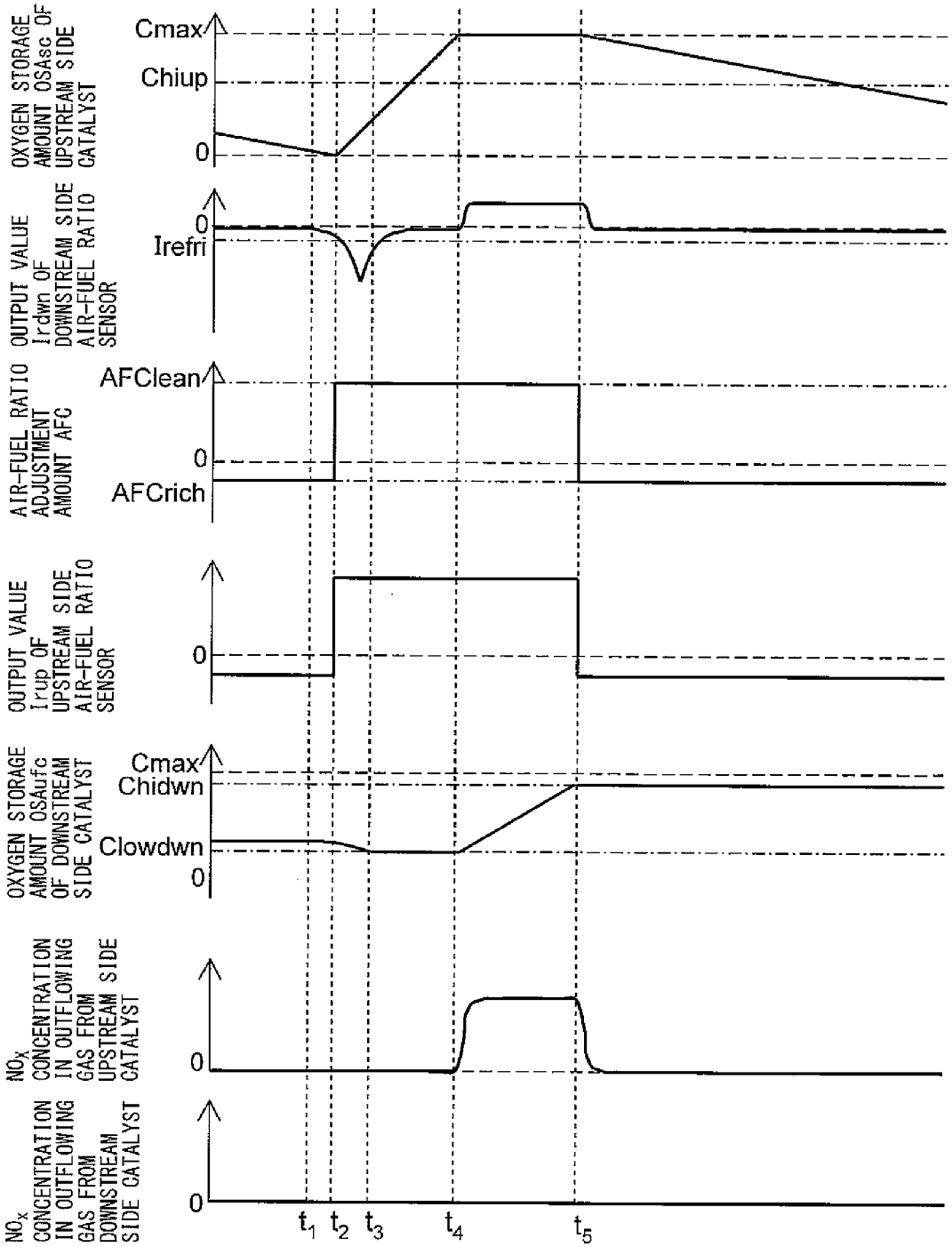
FIG. 9 is a time chart of the oxygen storage amount of the catalyst, etc.

Referring to FIG. 9, the above-mentioned operation will be explained specifically. FIG. 9 is a time chart of the oxygen storage amount OSAsc of the upstream side catalyst 20, etc., in the case of performing storage amount recovery control.

In the illustrated example, the state before the time $t_1$ is basically similar to the state before $t_1$ in FIG. 7, that is, normal control is performed. However, in the example which is shown in FIG. 9, before $t_1$, the oxygen storage amount OSAsc of the downstream side catalyst 24 is relatively small.

In the example shown in FIG. 9, in the same way as the example shown in FIG. 7, at the time $t_1$, part of the exhaust gas flowing into the upstream side catalyst 20 starts to flow out without being purified at the upstream side catalyst 20. Further, at the time $t_2$, the output current Irdwn of the downstream side air-fuel ratio sensor 41 reaches a rich judged reference value Irefri which corresponds to the rich judged air-fuel ratio. As a result, the air-fuel ratio adjustment amount AFC is switched to the lean set adjustment amount AFClean. However, even if the air-fuel ratio adjustment amount AFC is switched to the lean set adjustment amount AFClean, due to the delay in the change of the air-fuel ratio of the exhaust gas flowing out from the upstream side catalyst 20, unburned gas flows out from the upstream side catalyst 20 (due to this, the output current Irdwn of the downstream side air-fuel ratio sensor 41 falls).

During the times $t_2$ to $t_3$, if the unburned gas flowing out from the upstream side catalyst 20 flows into the downstream side catalyst 24, the oxygen, which had been stored at the downstream side catalyst 24, and the unburned gas react and the oxygen storage amount of the downstream side catalyst 24 falls. As a result, at the time $t_3$, the oxygen storage amount of the downstream side catalyst 24 reaches the downstream side lower limit storage amount Clowdwn, and thus normal control is stopped and storage amount recovery control is started.

At the time $t_3$, if the storage amount recovery control is started, the target air-fuel ratio is set to the lean set air-fuel ratio. That is, the air-fuel ratio adjustment amount AFC is set to the lean set adjustment amount AFClean corresponding to the lean set air-fuel ratio. In the present embodiment, since the air-fuel ratio adjustment amount AFC is set to the lean set adjustment amount AFClean before the start of storage amount recovery control, after the time $t_3$ as well, the air-fuel ratio adjustment amount AFC is maintained as it is.

If continuing to maintain the air-fuel ratio adjustment amount AFC at the lean set adjustment amount AFClean, a large amount of oxygen flows into the upstream side catalyst 20, and thus the oxygen storage amount OSAsc of the upstream side catalyst 20 increases, and finally, at the time $t_4$, reaches the maximum oxygen storage amount Cmax. If the oxygen storage amount OSAsc of the upstream side catalyst 20 reaches the maximum oxygen storage amount Cmax, the upstream side catalyst 20 can no longer store any further oxygen, and therefore oxygen flows out from the upstream side catalyst 20. Further, along with this, since, at the upstream side catalyst 20, $NO_X$ can no longer be purified, $NO_X$ also flows out from the upstream side catalyst 20.

Since the oxygen flowing out from the upstream side catalyst 20 is stored by the downstream side catalyst 24, the oxygen storage amount of the downstream side catalyst 24 increases. Further, the $NO_X$ which flows out from the upstream side catalyst 20 is purified by the downstream side catalyst 24. Therefore, the amount of discharge of $NO_X$ from the downstream side catalyst 24 is suppressed.

If continuing to maintain as is the air-fuel ratio adjustment amount AFC at the lean set adjustment amount AFClean, the oxygen storage amount OSAufc of the downstream side catalyst 24 gradually increases and finally, at the time $t_5$, the oxygen storage amount OSAufc reaches the downstream side upper limit storage amount Chidwn. When in this way the oxygen storage amount OSAufc of the downstream side catalyst 24 reaches the downstream side upper limit storage amount Chidwn, the downstream side catalyst 24 stores sufficient oxygen. Further, if not only oxygen but also $NO_X$ further flows out from the upstream side catalyst 20, finally the oxygen storage amount OSAufc of the downstream side catalyst 24 reaches the maximum oxygen storage amount Cmax and $NO_X$ becomes unable to be purified.

Therefore, in the present embodiment, at the time $t_5$, if the oxygen storage amount OSAufc of the downstream side catalyst 24 reaches the downstream side upper limit storage amount Chidwn, the storage amount recovery control is ended and normal control is resumed. Specifically, at the time $t_5$, the target air-fuel ratio is set to the weak rich set air-fuel ratio and accordingly the air-fuel ratio adjustment amount AFC is set to the weak rich set adjustment amount AFCrich. Due to this, exhaust gas containing unburned gas flows into the upstream side catalyst 20 and the oxygen storage amount OSAsc of the upstream side catalyst 20 is gradually decreased.

As will be understood from the above explanation, according to the present embodiment, even if the oxygen storage amount OSAufc of the downstream side catalyst 24 decreases, the oxygen storage amount OSAufc can be recovered. Due to this, the oxygen storage amount OSAufc of the downstream side catalyst 24 can constantly be maintained at a sufficient amount and accordingly even if performing normal control, the unburned gas flowing out from the upstream side catalyst 20 can constantly be reliably removed at the downstream side catalyst 24.

In particular, in the present embodiment, when the oxygen storage amount OSAufc of the downstream side catalyst 24 decreases, the target air-fuel ratio is continuously fixed to a lean value which is relatively higher than the stoichiometric air-fuel ratio. For this reason, the oxygen storage amount OSAufc of the downstream side catalyst 24 can be increased in a short time. In this regard, if the exhaust gas flowing into the upstream side catalyst 20 becomes a lean air-fuel ratio over a long time period, the upstream side catalyst 20 easily stores the sulfur component in the exhaust gas. According to the present embodiment, since the oxygen storage amount OSAufc of the downstream side catalyst 24 can be made to increase in a short time, the time period, during which the exhaust gas flowing into the upstream side catalyst 20 is set to a lean air-fuel ratio, becomes shorter and, as a result, the storage of sulfur in the upstream side catalyst 20 can be suppressed.

<Explanation of Specific Control>

Figure 10:
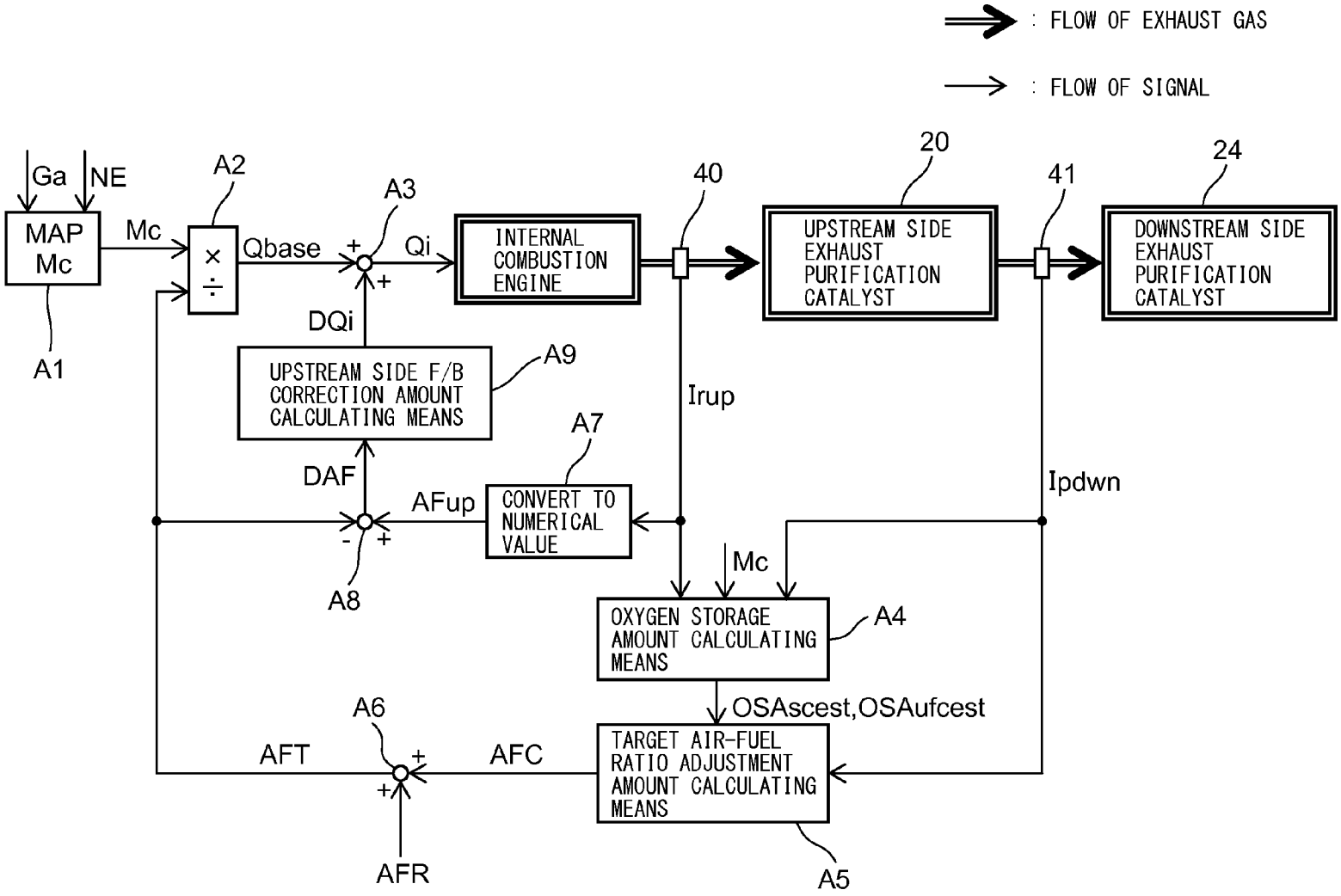
FIG. 10 is a functional block diagram of a control system.
Figure 11:
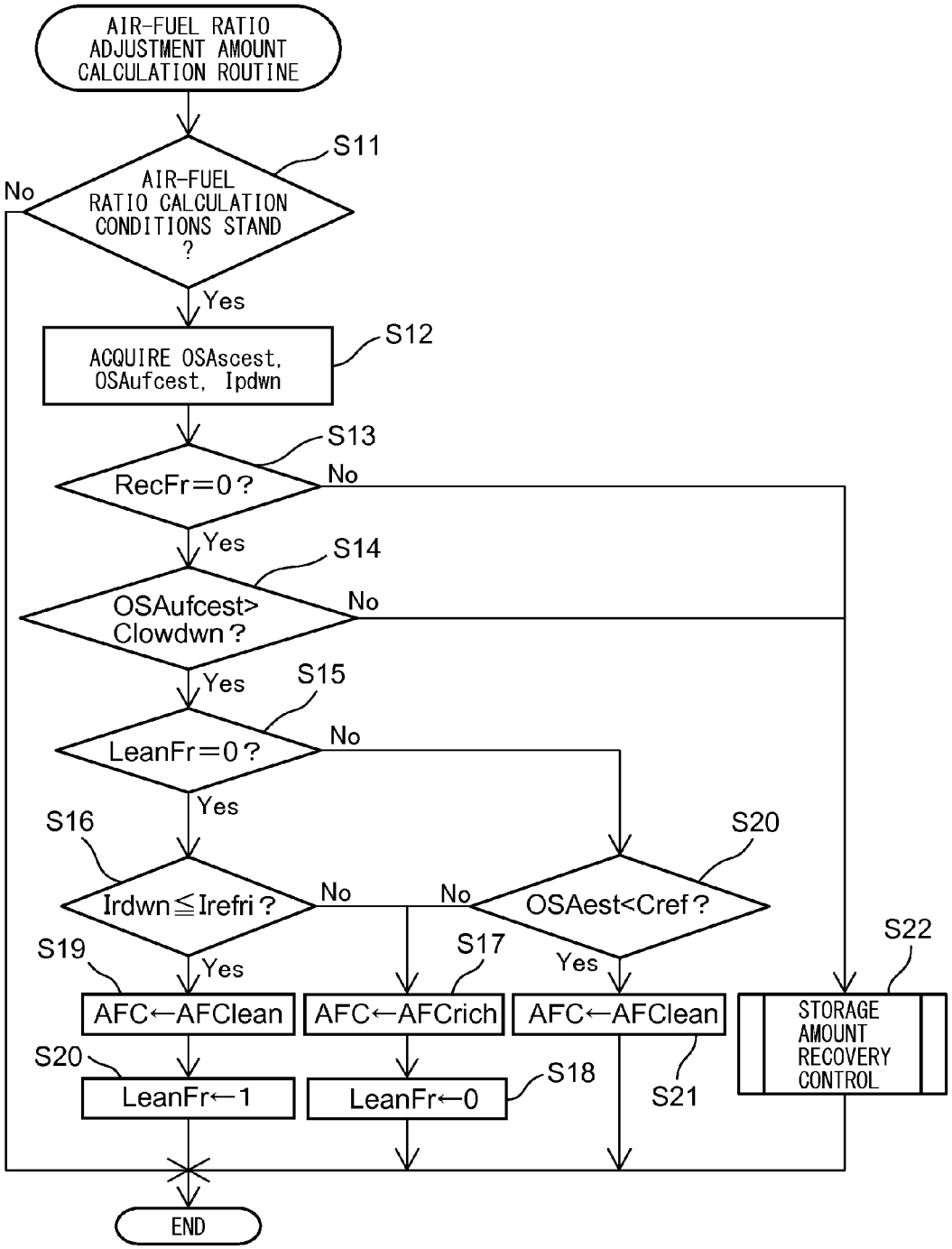
FIG. 11 is a flow chart which shows a control routine of control for calculation of an air-fuel ratio adjustment amount.
Figure 12:
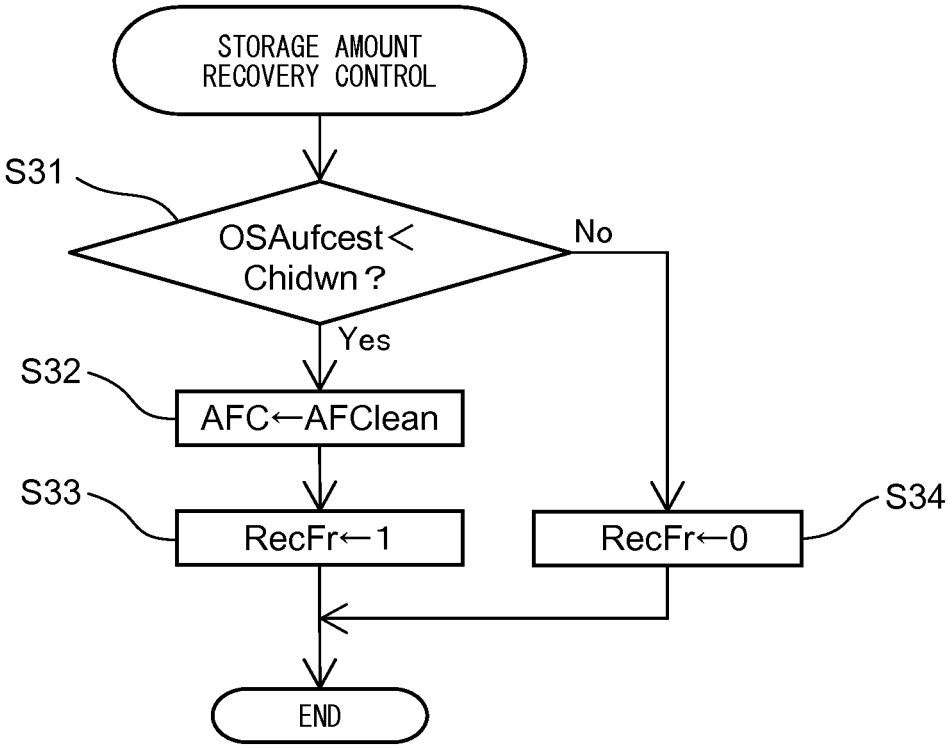
FIG. 12 is a flow chart which shows a control routine of control for recovery of storage amount.

Next, referring to FIGS. 10 to 12, the control system in the above embodiment will be specifically explained. The control system in the above embodiment, as shown by the functional block diagram of FIG. 10, is comprised of functional blocks A1 to A9. Below, referring to FIG. 10, these functional blocks will be explained.

<Calculation of Fuel Injection>

First, calculation of the fuel injection will be explained. In calculating the fuel injection, the cylinder intake air calculating means A1, basic fuel injection calculating means A2, and fuel injection calculating means A3 are used.

The cylinder intake air calculating means A1 calculates the intake air amount Mc to each cylinder based on the intake air flow rate Ga measured by the air flow meter 39, the engine speed NE calculated based on the output of the crank angle sensor 44, and the map or calculation formula stored in the ROM 34 of the ECU 31.

The basic fuel injection calculating means A2 divides the cylinder intake air amount Mc, which is calculated by the cylinder intake air calculating means A1, by the target air-fuel ratio AFT which is calculated by the later explained target air-fuel ratio setting means A6 to thereby calculate the basic fuel injection amount Qbase (Qbase=Mc/AFT).

The fuel injection calculating means A3 adds the basic fuel injection amount Qbase calculated by the basic fuel injection calculating means A2 and the later explained F/B correction amount DQi, to calculate the fuel injection amount Qi (Qi=Qbase+DQi). The fuel injector 11 is commanded to inject fuel so that the fuel of the fuel injection amount Qi which was calculated in this way is injected.

<Calculation of Target Air-Fuel Ratio>

Next, calculation of the target air-fuel ratio will be explained. In calculation of the target air-fuel ratio, an oxygen storage amount calculating means A4, target air-fuel ratio correction amount calculating means A5, and target air-fuel ratio setting means A6 are used.

The oxygen storage amount calculating means A4 calculates the estimated value OSAscest of the oxygen storage amount of the upstream side catalyst 20 and the estimated value OSAufcest of the oxygen storage amount of the downstream side catalyst 24, based on the fuel injection amount Qi which was calculated by the fuel injection amount calculating means A3 (or the cylinder intake air amount Mc which was calculated by the cylinder intake air amount calculating means A1), the output current Irup of the upstream side air-fuel ratio sensor 40, and the output current Irdwn of the downstream side air-fuel ratio sensor 41.

For example, the oxygen storage amount calculating means A4 estimate the oxygen storage amounts by the following formulas (2) and (3).

$$OSAscest(k)=0.23\times(AFIrup(k)-AFst)\times Qi(k)+OSAscest(k-1) \quad (2)$$

$$OSAufcest(k)=0.23\times(AFIrdwn(k)-AFst)\times Qi(k)+OSAufcest(k-1) \quad (3)$$

In the above formulas (2) and (3), AFIrup is the air-fuel ratio which corresponds to the output current Irup of the upstream side air-fuel ratio sensor 40, AFIrdwn is the air-fuel ratio which corresponds to the output current Irdwn of the downstream side air-fuel ratio sensor 41, AFst is the stoichiometric air-fuel ratio, 0.23 is the mass ratio of oxygen in the air, and "k" is the number of times of calculation. Accordingly, k−1 means the value at the previous time of calculation. Further, when fuel cut control has been performed, the estimated values of oxygen storage amounts of the two catalysts are set to the maximum oxygen storage amounts.

Note that, the oxygen storage amount calculating means A4 need not constantly estimate the oxygen storage amount of the upstream side catalyst 20. For example, it is possible to estimate the oxygen storage amount only for the period from when the target air-fuel ratio is actually switched from the rich air-fuel ratio to the lean air-fuel ratio (time $t_3$ in FIG. 7) to when the estimated value OSAest of the oxygen storage amount reaches the upstream side judged reference storage amount Chiup (time $t_4$ in FIG. 7).

In the target air-fuel ratio adjustment amount calculating means A5, the air-fuel ratio adjustment amount AFC of the target air-fuel ratio is calculated, based on the estimated value OSAscest and OSAufcest of the oxygen storage amount calculated by the oxygen storage amount calculating means A4 and the output current Irdwn of the downstream side air-fuel ratio sensor 41. Specifically, the air-fuel ratio adjustment amount AFC is set as stated below referring to FIGS. 11 and 12.

The target air-fuel ratio setting means A6 adds the reference air-fuel ratio, which is, in the present embodiment, the stoichiometric air-fuel ratio AFR, and the air-fuel ratio adjustment amount AFC calculated by the target air-fuel ratio adjustment amount calculating means A5 to thereby calculate the target air-fuel ratio AFT. Therefore, the target air-fuel ratio AFT is set to either a weak rich set air-fuel ratio (when the air-fuel ratio adjustment amount AFC is a weak rich set adjustment amount AFCrich) or a lean set air-fuel ratio (when the air-fuel ratio adjustment amount AFC is a lean set adjustment amount AFClean). The thus calculated target air-fuel ratio AFT is input to the basic fuel injection calculating means A2 and the later explained air-fuel ratio difference calculating means A8.

FIG. 11 is a flow chart of a control routine of control for calculation of the air-fuel ratio adjustment amount AFC. The illustrated control routine is performed by interruption every certain time interval.

As shown in FIG. 11, first, at step S11, it is judged if the conditions for calculation of the air-fuel ratio adjustment amount AFC stand. The conditions for calculation of the air-fuel ratio adjustment amount stand, for example, when fuel cut control is not underway, etc. When it is judged at step S11 that the conditions for calculation of the target air-fuel ratio stand, the routine proceeds to step S12. At S12, the estimated value OSAscest of the oxygen storage amount of the upstream side catalyst 20 and the estimated value OSAufcest of the oxygen storage amount of the downstream side catalyst 24 which were calculated by the oxygen storage amount estimating means A4 and the output current Irdwn of the downstream side air-fuel ratio sensor 41 are obtained.

Next, at step S13, it is judged if a recovery control flag RecFr is set to "0". The recovery control flag RecFr is a flag which is set to "1" during storage amount recovery control and is set to "0" otherwise. When storage amount recovery control is not being performed, the recovery control flag RecFr is set to "0" and the routine proceeds to step S14. At step S14, it is judged if the estimated value OSAufcest of the oxygen storage amount of the downstream side catalyst 24 is larger than the downstream side lower limit storage amount Clowdwn. If the estimated value OSAufcest of the oxygen storage amount is larger than the downstream side lower limit storage amount Clowdwn, the routine proceeds to step S15.

At step S15, it is judged if the lean set flag LeanFr is set to "0". The lean set flag LeanFr is set to "1" if the air-fuel ratio adjustment amount AFC is set to the lean set adjustment amount AFClean and is set to "0" otherwise. If at step S15 the lean set flag Fr is set to "0", the routine proceeds to step S16.

At step S16, it is judged if the output current Irdwn of the downstream side air-fuel ratio sensor 41 is the rich judged reference value Irefri or less. If the upstream side catalyst 20 stores sufficient oxygen and the air-fuel ratio of the exhaust gas flowing out from the upstream side catalyst 20 is substantially the stoichiometric air-fuel ratio, it is judged that the output current Irdwn of the downstream side air-fuel ratio sensor 41 is larger than the rich judged reference value Irefri and the routine proceeds to step S17. At step S17, the air-fuel ratio adjustment amount AFC is set to the weak rich set adjustment amount AFCrich, next, at step S18, the lean set flag Fr is set to "0", then the control routine is ended.

On the other hand, if the oxygen storage amount OSAsc of the upstream side catalyst 20 decreases and the air-fuel ratio of the exhaust gas flowing out from the upstream side catalyst 20 falls, at step S16, it is judged that the output current Irdwn of the downstream side air-fuel ratio sensor 41 is the rich judged reference value Irefri or less, and then the routine proceeds to step S19. At step S19, the air-fuel ratio adjustment amount AFC is set to the lean set adjustment amount AFClean, and next, at step S20, the lean set flag LeanFr is set to "1", then the control routine is ended.

At the next control routine, at step S15, it is judged that the lean set flag LeanFr is not set to "0", then the routine proceeds to step S20. At step S20, it is judged if the estimated value OSAscest of the oxygen storage amount of the upstream side catalyst 20 which was acquired at step S12 is smaller than the upstream side judged reference storage amount Chiup. If it is judged that the estimated value OSAscest is smaller than the upstream side judged reference storage amount Chiup, the routine proceeds to step S21 where the air-fuel ratio adjustment amount AFC continues to be set to the lean set adjustment amount AFClean. On the other hand, if the oxygen storage amount of the upstream side catalyst 20 increases, finally, at step S20, it is judged that the estimated value OSAscest of the oxygen storage amount of the upstream side catalyst 20 is the upstream side judged reference storage amount Chiup or more and the routine proceeds to step S17. At step S17, the air-fuel ratio adjustment amount AFC is set to the weak rich set adjustment amount AFCrich, and next, at step S18, the lean set flag LeanFr is reset to "0", then the control routine is ended.

On the other hand, if the oxygen storage amount of the downstream side catalyst 24 decreases, at the next control routine, at step S14, it is judged that the estimated value OSAufcest of the oxygen storage amount of the downstream side catalyst 24 is the downstream side lower limit storage amount Clowdwn or less, and then the routine proceeds to step S22 where the storage amount recovery control is performed.

FIG. 12 is a flow chart which shows a control routine of storage amount recovery control. As shown in FIG. 12, first, at step S31, it is judged if the estimated value OSAufcest of the oxygen storage amount of the downstream side catalyst 24 is smaller than the downstream side upper limit storage amount Chidwn. If the oxygen storage amount of the downstream side catalyst 24 does not sufficiently recover and accordingly the estimated value OSAufcest of the oxygen storage amount of the downstream side catalyst 24 is smaller than the downstream side upper limit storage amount Chidwn, the routine proceeds to step S32. At step S32, the air-fuel ratio adjustment amount AFC is set to the lean set adjustment amount AFClean, and next, at step S33, the recovery control flag RecFr is left as "1".

On the other hand, if the oxygen storage amount of the downstream side catalyst 24 increases, at the next control routine, at step S31, it is judged that the estimated value OSAufcest of the oxygen storage amount of the downstream side catalyst 24 is the downstream side upper limit storage amount Chidwn or more, and then the routine proceeds to step S34. At step S34, the recovery control flag RecFr is set to "0" and the control routine is ended.

<Calculation of F/B Correction Amount>

Returning again to FIG. 10, calculation of the F/B correction amount based on the output current Irup of the upstream side air-fuel ratio sensor 40 will be explained. In calculation of the F/B correction amount, the numerical value converting means A7, air-fuel ratio difference calculating means A8, and F/B correction amount calculating means A9 are used.

The numerical value converting means A7 calculates the upstream side exhaust air-fuel ratio AFup corresponding to the output current Irup based on the output current Irup of the upstream side air-fuel ratio sensor 40 and a map or calculation formula (for example, the map as shown in FIG. 5) which defines the relationship between the output current Irup and the air-fuel ratio of the air-fuel ratio sensor 40. Therefore, the upstream side exhaust air-fuel ratio AFup corresponds to the air-fuel ratio of the exhaust gas flowing into the upstream side catalyst 20.

The air-fuel ratio difference calculating means A8 subtracts the target air-fuel ratio AFT calculated by the target air-fuel ratio setting means A6 from the upstream side exhaust air-fuel ratio AFup calculated by the numerical value converting means A7 to thereby calculate the air-fuel ratio difference DAF (DAF=AFup−AFT). This air-fuel ratio difference DAF is a value which expresses excess/deficiency of the amount of fuel fed with respect to the target air-fuel ratio AFT.

The F/B correction amount calculating means A9 processes the air-fuel ratio difference DAF calculated by the air-fuel ratio difference calculating means A8 by proportional integral derivative processing (PID processing) to thereby calculate the F/B correction amount DFi for compensating for the excess/deficiency of the amount of feed of fuel based on the following equation (1). The thus calculated F/B correction amount DFi is input to the fuel injection calculating means A3.

$$DFi=Kp\cdot DAF+Ki\cdot SDAF+Kd\cdot DDAF \quad (1)$$

Note that, in the above equation (1), Kp is a preset proportional gain (proportional constant), Ki is a preset integral gain (integral constant), and Kd is a preset derivative gain (derivative constant). Further, DDAF is the time derivative value of the air-fuel ratio difference DAF and is calculated by dividing the difference between the currently updated air-fuel ratio difference DAF and the previously updated air-fuel ratio difference DAF by the time corresponding to the updating interval. Further, SDAF is the time derivative value of the air-fuel ratio difference DAF. This time derivative value DDAF is calculated by adding the previously updated time derivative value DDAF and the currently updated air-fuel ratio difference DAF (SDAF=DDAF+DAF).

Note that, in the above embodiment, the air-fuel ratio of the exhaust gas flowing into the upstream side catalyst 20 is detected by the upstream side air-fuel ratio sensor 40. However, the precision of detection of the air-fuel ratio of the exhaust gas flowing into the upstream side catalyst 20 does not necessarily have to be high, and therefore, for example, the air-fuel ratio of the exhaust gas may be estimated based on the fuel injection amount from the fuel injector 11 and output of the air flow meter 39.

Second Embodiment

Next, referring to FIG. 13, a control system of an internal combustion engine according to a second embodiment of the present invention will be explained. The configuration and control of the control system of an internal combustion engine of the second embodiment are basically the same as the configuration and control of the control system of an internal combustion engine according to the first embodiment. However, in the control system of the above first embodiment, at the time of storage amount recovery control, the target air-fuel ratio was set to a predetermined air-fuel ratio which was leaner than the stoichiometric air-fuel ratio by a certain extent, while in the control system of the present embodiment, at the time of storage amount recovery control, the target air-fuel ratio is set to a predetermined air-fuel ratio which is slightly leaner than the stoichiometric air-fuel ratio (weak lean set air-fuel ratio).

In the present embodiment, this air-fuel ratio is an air-fuel ratio which is lower than the lean set air-fuel ratio at normal control. For example, this air-fuel ratio is 14.62 to 15.7, preferably 14.63 to 15.2, more preferably 14.65 to 14.9 or so. Therefore, in the present embodiment, the difference between the time average value of the target air-fuel ratio and the stoichiometric air-fuel ratio when the target air-fuel ratio is continuously set lean is preferably smaller than the difference between the time average value of the target air-fuel ratio and the stoichiometric air-fuel ratio when the target air-fuel ratio is set leaner than the stoichiometric air-fuel ratio by the normal period lean control means.

Figure 13:
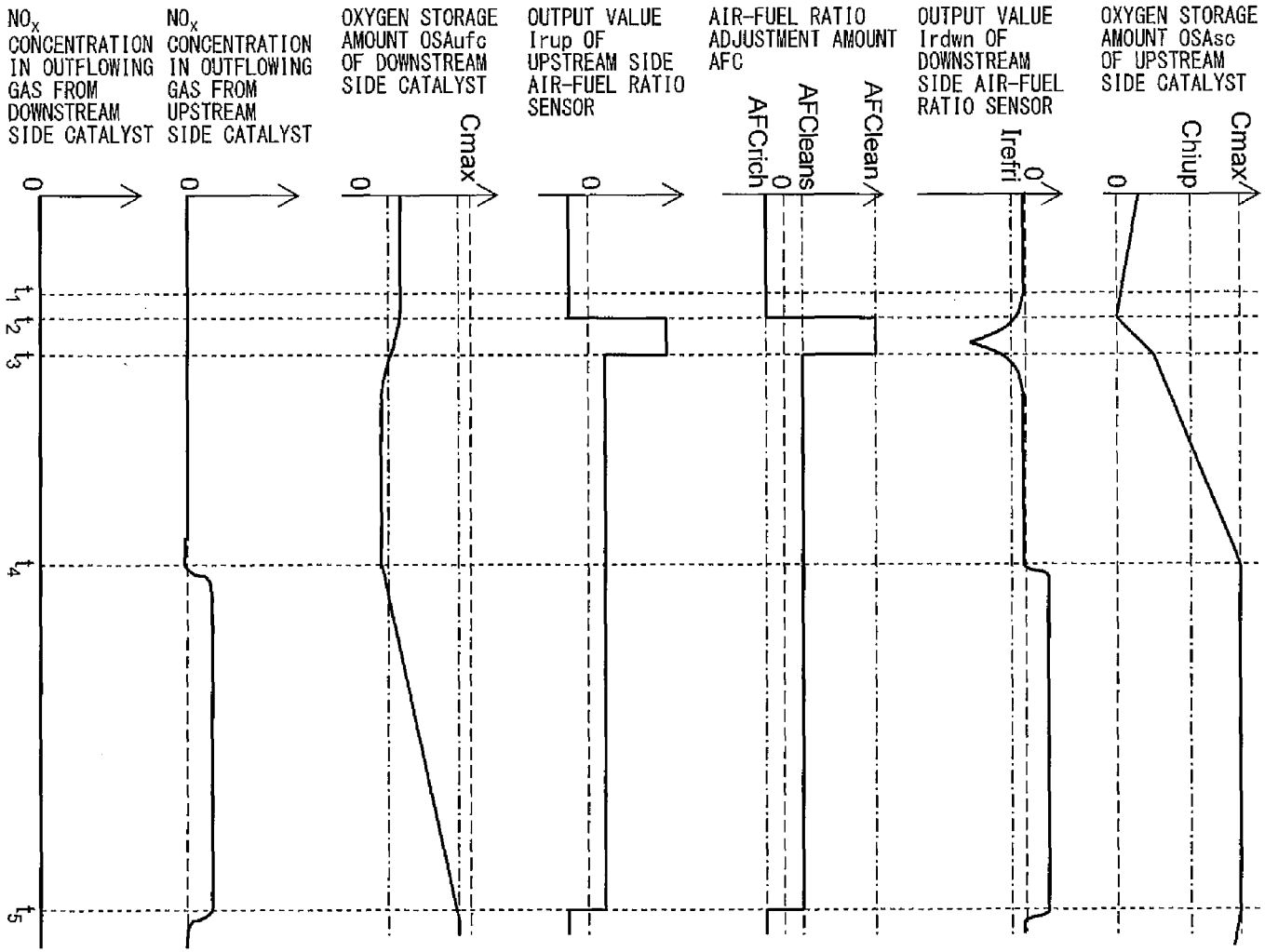
FIG. 13 is a time chart of the oxygen storage amount of the catalyst, etc.

FIG. 13 is a time chart of the oxygen storage amount OSAsc of the upstream side catalyst 20, etc., in the case of performing the storage amount recovery control in the present embodiment. Before the time $t_3$, normal control is performed in the same way as the example shown in FIG. 9. At the time $t_3$, if the oxygen storage amount of the downstream side catalyst 24 reaches the downstream side lower limit storage amount Clowdwn and thus storage amount recovery control is started, the target air-fuel ratio is switched from the lean set air-fuel ratio to the weak lean set air-fuel ratio. That is, at the time $t_3$, the air-fuel ratio adjustment amount AFC is set to the weak lean set adjustment amount AFCleans which corresponds to the weak lean set air-fuel ratio.

If maintaining the air-fuel ratio adjustment amount AFC as set to the weak lean set adjustment amount AFCleans, at the time $t_4$, the oxygen storage amount OSAsc of the upstream side catalyst 20 reaches the maximum oxygen storage amount Cmax, and thus oxygen starts to flow out from the upstream side catalyst 20. Due to this, the oxygen storage amount of the downstream side catalyst 24 increases and, at the time $t_5$, the oxygen storage amount OSAufc of the downstream side catalyst 24 reaches the downstream side upper limit storage amount Chidwn.

In this way, in the present embodiment, the target air-fuel ratio during storage amount recovery control is set to a weak lean set air-fuel ratio which is slightly leaner than the stoichiometric air-fuel ratio. For this reason, even if something causes the oxygen storage amount OSAufc of the downstream side catalyst 24 to reach the maximum oxygen storage amount during storage amount recovery control, only exhaust gas which is slightly leaner than the stoichiometric air-fuel ratio will flow out from the downstream side catalyst 24. Therefore, according to the present embodiment, even if $NO_X$ flows out from the downstream side catalyst 24, the amount of outflow can be kept to a minimum extent.

Third Embodiment

Next, referring to FIG. 14, a control system of an internal combustion engine according to a third embodiment of the present invention will be explained. The configuration and control of the control system of an internal combustion engine of the third embodiment are basically the same as the configuration and control of the control system of an internal combustion engine of the above embodiments. However, in the control system of the above embodiments, at the time of storage amount recovery control, the target air-fuel ratio was maintained constant, while in the control system of the present embodiment, at the time of storage amount recovery control, the target air-fuel ratio gradually decreases.

Figure 14:
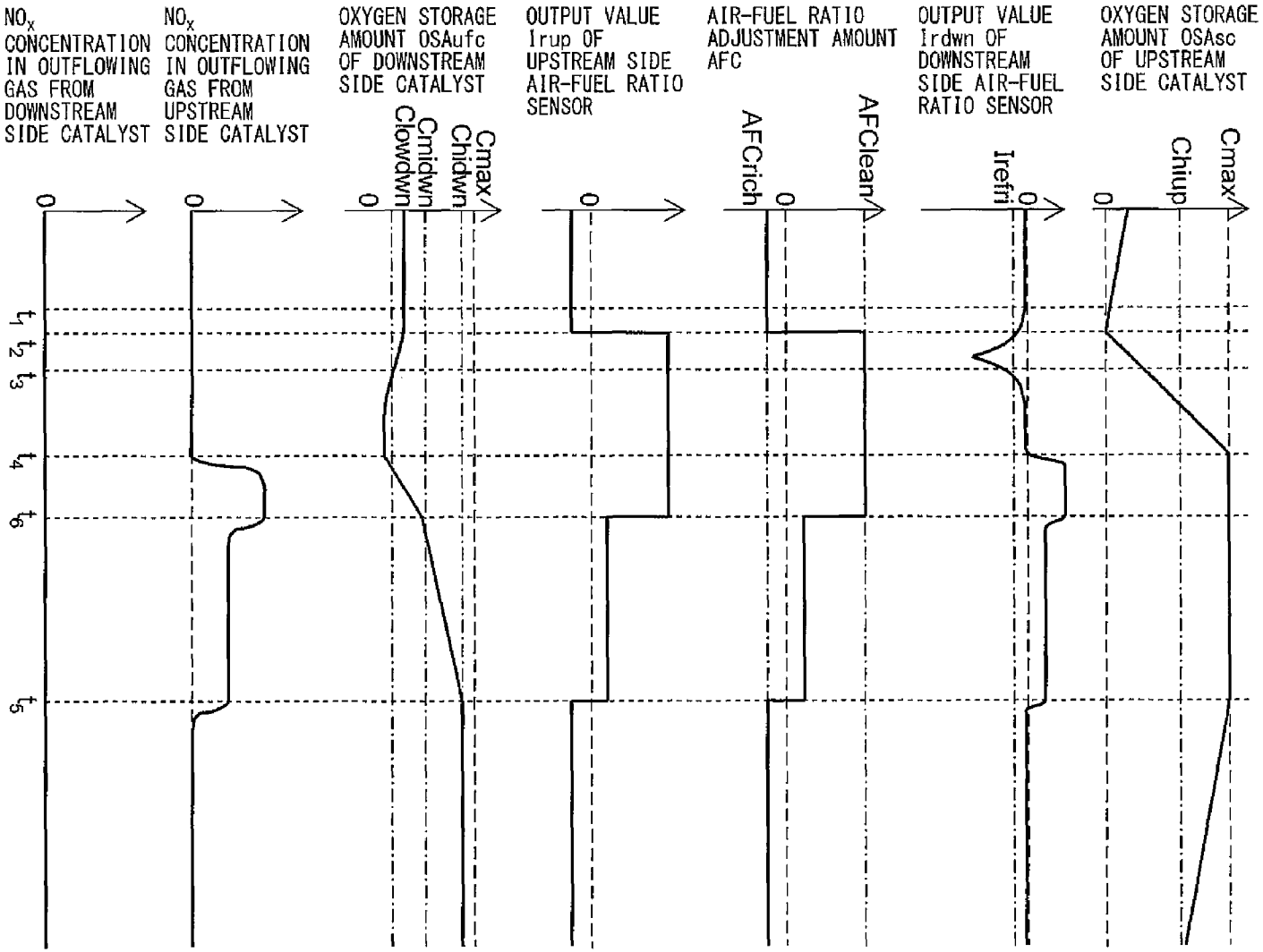
FIG. 14 is a time chart of the oxygen storage amount of the catalyst, etc.

FIG. 14 is a time chart of the oxygen storage amount OSAsc of the upstream side catalyst 20, etc., in the case of performing the storage amount recovery control in the present embodiment. Before the time $t_3$, in the same way as the example shown in FIG. 9, normal control is performed. At the time $t_3$, if the oxygen storage amount of the downstream side catalyst 24 reaches the downstream side lower limit storage amount Clowdwn and thus the storage amount recovery control is started, first, in the same way as the example shown in FIG. 9, the air-fuel ratio adjustment amount AFC is maintained to be set to the lean set adjustment amount AFClean which corresponds to the lean set air-fuel ratio which is leaner than the stoichiometric air-fuel ratio by a certain extent.

After that, at the time $t_4$, the oxygen storage amount OSAsc of the upstream side catalyst 20 reaches the maximum oxygen storage amount Cmax and oxygen starts to flow out from the upstream side catalyst 20. Due to this, the oxygen storage amount of the downstream side catalyst 24 starts to increase. In the present embodiment, if the oxygen storage amount OSAsc of the downstream side catalyst 24 starts to increase and reaches a predetermined middle storage amount Cmidwn between the downstream side upper limit storage amount Chidwn and the downstream side lower limit storage amount Clowdwn, the air-fuel ratio adjustment amount AFC is switched to the weak lean set air-fuel ratio. Due to this, the speed of increase of the oxygen storage amount OSAufc of the downstream side catalyst 24 falls. After that, at the time $t_5$, the oxygen storage amount OSAufc of the downstream side catalyst 24 reaches the downstream side upper limit storage amount Chidwn.

In this way, in the present embodiment, at the time of start of storage amount recovery control, the target air-fuel ratio is set leaner than the stoichiometric air-fuel ratio to a certain extent, and therefore, first, the oxygen storage amount OSAufc of the downstream side catalyst 24 can be increased in a relatively short time. In addition, if the oxygen storage amount OSAufc of the downstream side catalyst 24 increases to a certain extent, since the target air-fuel ratio was set slightly leaner than the stoichiometric air-fuel ratio, even if something causes the oxygen storage amount OSAufc of the downstream side catalyst 24 to reach the maximum oxygen storage amount during storage amount recovery control, only exhaust gas which is slightly leaner than the stoichiometric air-fuel ratio will flow out from the downstream side catalyst 24. Therefore, according to the present embodiment, the oxygen storage amount OSAufc of the downstream side catalyst 24 can increase in a relatively short time, while the outflow of $NO_X$ from the downstream side catalyst 24 can be suppressed.

Fourth Embodiment

Next, referring to FIG. 15, a control system of an internal combustion engine according to a fourth embodiment of the present invention will be explained. The configuration and control of the control system of an internal combustion engine of the fourth embodiment are basically the same as the configuration and control of the control system of an internal combustion engine of the above embodiments. However, in the control systems of the above embodiments, at the time of storage amount recovery control, the target air-fuel ratio was constantly maintained lean, while in the control system of the control system, at the time of storage amount recovery control, the target air-fuel ratio is intermittently set to lean.

In the present embodiment, in the storage amount recovery control, the target air-fuel ratio is set based on the output current Irdwn of the downstream side air-fuel ratio sensor 41. Specifically, when the output current Irdwn of the downstream side air-fuel ratio sensor 41 becomes the lean judged reference value Irefle or more, the target air-fuel ratio is set to a rich set air-fuel ratio and is maintained at that air-fuel ratio. In this regard, the lean judged reference value Irefle is a value corresponding to a predetermined lean judged air-fuel ratio which is slightly leaner than the stoichiometric air-fuel ratio (for example, 14.65). Further, the rich set air-fuel ratio is a predetermined air-fuel ratio which is richer than the stoichiometric air-fuel ratio by a certain extent, and for example, is 10 to 14.55, preferably 12 to 14.52, more preferably 13 to 14.5 or so. At this time, the exhaust gas flowing out from the upstream side catalyst 20 becomes slightly lean, and therefore, due to this, oxygen flows into the downstream side catalyst 24 and the oxygen storage amount OSAufc of the downstream side catalyst 24 is increased.

If the target air-fuel ratio is changed to the rich set air-fuel ratio, the estimated value of the oxygen storage amount OSAsc of the upstream side catalyst 20 is obtained. Further, if the estimated value of the oxygen storage amount OSAsc of the upstream side catalyst 20 becomes the predetermined upstream side lower limit storage amount Clowup or less, the target air-fuel ratio, which had up to then been the rich set air-fuel ratio, is set to a weak lean set air-fuel ratio, and then is maintained at that air-fuel ratio. The weak lean set air-fuel ratio is a predetermined air-fuel ratio which is slightly leaner than the stoichiometric air-fuel ratio, for example, is 14.62 to 15.7, preferably 14.63 to 15.2, more preferably 14.65 to 14.9 or so. After that, when the output current Irdwn of the downstream side air-fuel ratio sensor 41 again becomes the lean judged reference value Irefle or more, the target air-fuel ratio of the exhaust gas flowing into the upstream side catalyst 20 is again set to the rich set air-fuel ratio, and then a similar operation is repeated during storage amount recovery control.

In this way, in the present embodiment, during storage amount recovery control, the air-fuel ratio of the exhaust gas flowing into the upstream side catalyst 20 is alternately set to the rich set air-fuel ratio and the weak lean set air-fuel ratio. In particular, in the present embodiment, the difference of the rich set air-fuel ratio from the stoichiometric air-fuel ratio is larger than the difference of the weak lean set air-fuel ratio from the stoichiometric air-fuel ratio. Therefore, in the present embodiment, the air-fuel ratio of the exhaust gas flowing into the upstream side catalyst 20 is alternately set to the rich set air-fuel ratio for a short time period, and the weak lean set air-fuel ratio for a long time period. Note that, such control can be said to be control where the "rich" and "lean" in the normal control are inverted.

Figure 15:
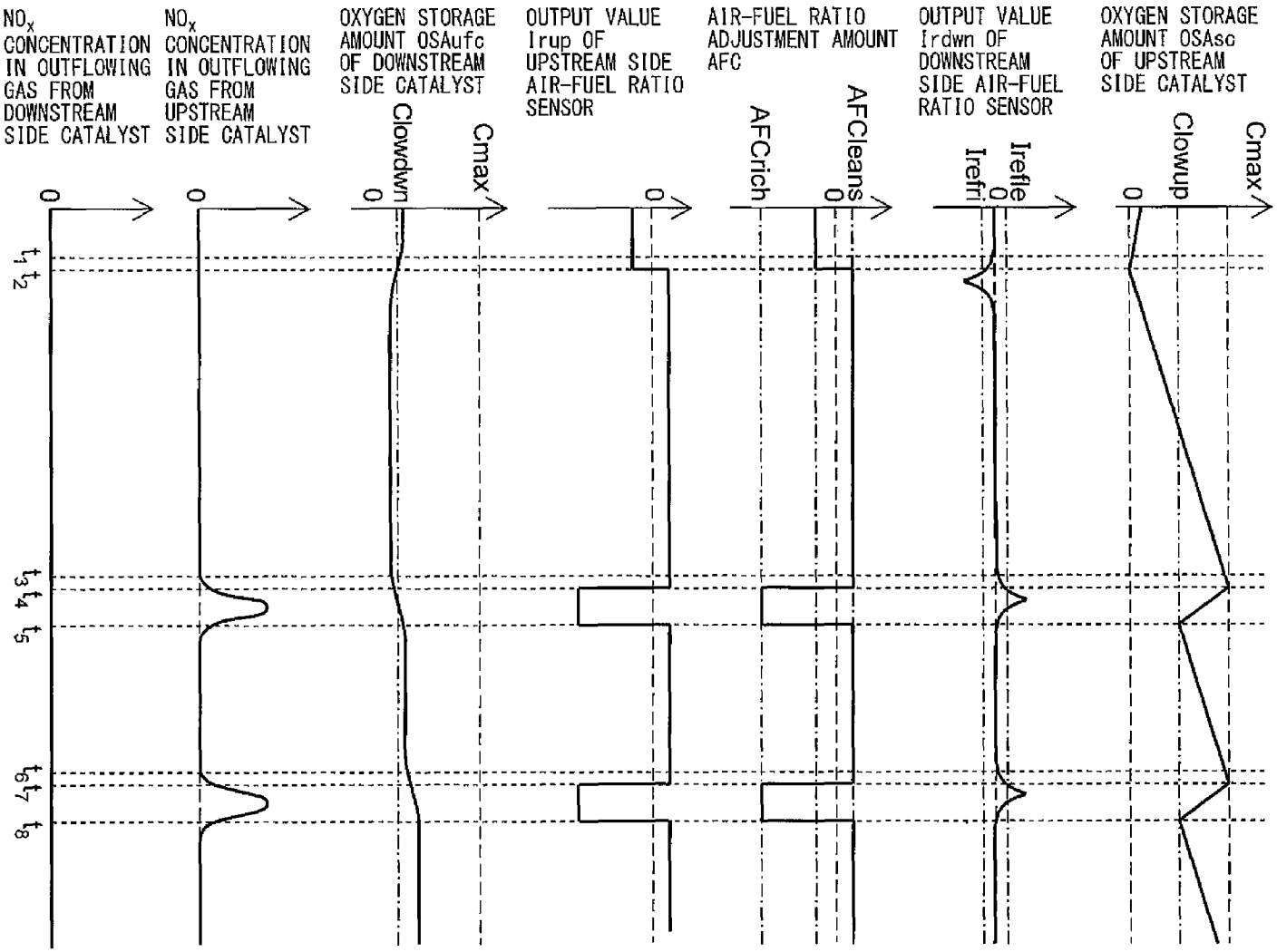
FIG. 15 is a time chart of the oxygen storage amount of the catalyst, etc.

FIG. 15 is a time chart of the oxygen storage amount OSAsc of the upstream side catalyst 20, etc., in the case of performing the storage amount recovery control in the present embodiment. In the example shown in FIG. 15, before the time $t_2$, normal control is performed. At the time $t_1$, part of the exhaust gas flowing into the upstream side catalyst 20 starts to flow out without being purified at the upstream side catalyst 20. Further, at the time $t_2$, the oxygen storage amount OSAufc of the downstream side catalyst 24 reaches the downstream side lower limit storage amount Clowdwn, normal control is stopped, and storage amount recovery control is started.

At the time $t_2$, if storage amount recovery control is started, the oxygen storage amount OSAsc of the upstream side catalyst 20 is the predetermined upstream side lower limit storage amount Clowup or less, and therefore the target air-fuel ratio is set to the weak lean set air-fuel ratio and, along with this, the output current Irup of the upstream side air-fuel ratio sensor 40 becomes a positive value. Since the exhaust gas flowing into the upstream side catalyst 20 contains oxygen, the oxygen storage amount OSAsc of the upstream side catalyst 20 gradually increases. However, since the oxygen contained in the exhaust gas flowing into the upstream side catalyst 20 is stored at the upstream side catalyst 20, the output current Irdwn of the downstream side air-fuel ratio sensor becomes substantially 0 (equivalent to stoichiometric air-fuel ratio). At this time, the amounts of discharge of unburned gas and $NO_X$ from the upstream side catalyst 20 are suppressed.

Figure 2:
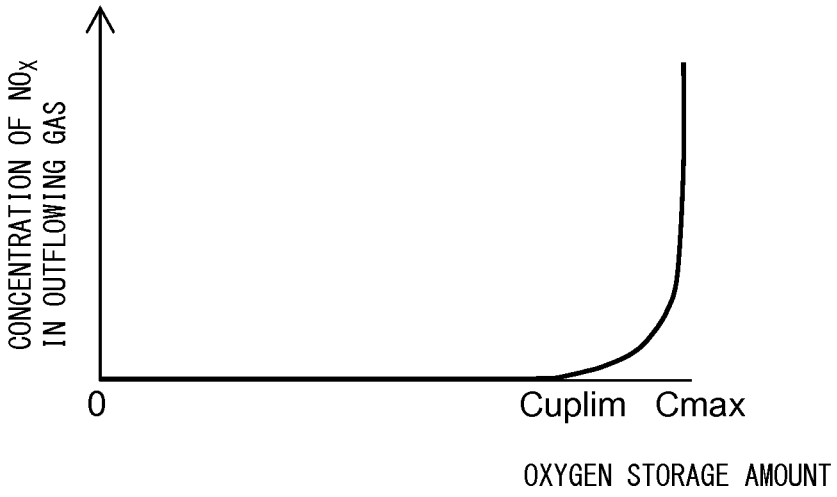
FIG. 2 is a view which shows the relationship between the oxygen storage amount of a catalyst and a concentration of $NO_X$ or unburned gas in exhaust gas flowing out from a catalyst.
Figure 2:
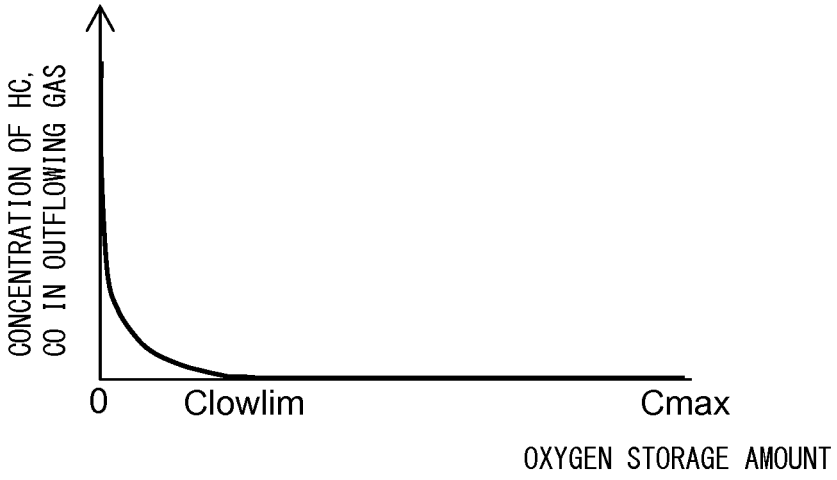

If the oxygen storage amount OSAsc of the upstream side catalyst 20 gradually increases, the oxygen storage amount OSAsc of the upstream side catalyst 20 increases beyond the upper limit storage amount (see FIG. 2, Cuplim). Due to this, part of the oxygen flowing into the upstream side catalyst 20 flows out without being stored at the upstream side catalyst 20. For this reason, after the time $t_3$, along with the increase of the oxygen storage amount OSAsc of the upstream side catalyst 20, the output current Irdwn of the downstream side air-fuel ratio sensor 41 gradually increases. At this time, oxygen and $NO_X$ is discharged from the upstream side catalyst 20. Due to this, the oxygen storage amount of the downstream side catalyst 24 increases and, further, the $NO_X$ flowing out from the upstream side catalyst 20 is purified by the downstream side catalyst 24.

After that, at the time $t_4$, the output current Irdwn of the downstream side air-fuel ratio sensor 41 reaches the lean judged reference value Irefle. In the present embodiment, if the output current Irdwn of the downstream side air-fuel ratio sensor 41 becomes the lean judged reference value Irefle, in order to suppress the increase in the oxygen storage amount OSAsc of the upstream side catalyst 20, the air-fuel ratio adjustment amount AFC is switched to a rich set adjustment amount AFCrich which corresponds to the rich set air-fuel ratio. Therefore, the target air-fuel ratio is set to the rich air-fuel ratio.

At the time $t_4$, if the target air-fuel ratio is switched to the rich air-fuel ratio, the air-fuel ratio of the exhaust gas flowing into the upstream side catalyst 20 also changes from the lean air-fuel ratio to the rich air-fuel ratio (in actuality, a delay occurs from when switching the target air-fuel ratio to when the air-fuel ratio of the exhaust gas flowing into the upstream side catalyst 20 changes, but in the illustrated example, for convenience, these are considered to change simultaneously).

At the time $t_4$, if the air-fuel ratio of the exhaust gas flowing into the upstream side catalyst 20 changes to the rich air-fuel ratio, the oxygen storage amount OSAsc of the upstream side catalyst 20 decreases. Further, along with this, the air-fuel ratio of the exhaust gas flowing out from the upstream side catalyst 20 changes to the stoichiometric air-fuel ratio and the output current Irdwn of the output current of the downstream side air-fuel ratio sensor 41 also converges. Note that, in the illustrated example, right after switching the target air-fuel ratio, the output current Irdwn of the downstream side air-fuel ratio sensor 41 rises. This is because a delay occurs from when the target air-fuel ratio is switched to when the exhaust gas reaches the downstream side air-fuel ratio sensor 41.

At this time, although the air-fuel ratio of the exhaust gas flowing into the upstream side catalyst 20 is a rich air-fuel ratio, the upstream side catalyst 20 contains a large amount of oxygen, and therefore the unburned gas in the exhaust gas is purified at the upstream side catalyst 20. For this reason, the amounts of discharge of $NO_X$ and unburned gas from the upstream side catalyst 20 are suppressed.

After that, if the oxygen storage amount OSAsc of the upstream side catalyst 20 decreases, at the time $t_5$, the oxygen storage amount OSAsc reaches the upstream side lower limit storage amount Clowup. In the present embodiment, if the oxygen storage amount OSAsc increases to the upstream side lower limit storage amount Clowup, in order to stop discharge of oxygen from the upstream side catalyst 20, the air-fuel ratio adjustment amount AFC is switched to the weak lean set adjustment amount AFCleans. Therefore, the target air-fuel ratio of the exhaust gas flowing into the upstream side catalyst 20 is set to the lean air-fuel ratio.

Note that, as explained above, in the illustrated example, at the same time that the target air-fuel ratio is switched, the air-fuel ratio of the exhaust gas flowing into the upstream side catalyst 20 also changes, but in actuality a delay occurs. For this reason, even if switching at the time $t_5$, the air-fuel ratio of the exhaust gas flowing into the upstream side catalyst 20 changes from a lean air-fuel ratio to a rich air-fuel ratio after the elapse of a certain extent of time. Therefore, until the air-fuel ratio of the exhaust gas flowing into the upstream side catalyst 20 changes to the rich air-fuel ratio, the oxygen storage amount OSAsc of the upstream side catalyst 20 increases.

However, since the upstream side lower limit storage amount Clowup is set sufficiently higher than zero or the lower limit storage amount Clowlim, even at the time $t_5$, the oxygen storage amount OSAsc will not reach zero or the lower limit storage amount Clowlim. Conversely speaking, the upstream side lower limit storage amount Clowup is set to an amount so that even if a delay occurs from when the target air-fuel ratio is switched to when the air-fuel ratio of the exhaust gas flowing into the upstream side catalyst 20 actually changes, the oxygen storage amount OSAsc will not reach zero or the lower limit storage amount Clowlim. For example, the upstream side lower limit storage amount Clowup is ¼ or more, preferably ½ or more, more preferably ⅘ or more, of the maximum oxygen storage amount Cmax.

After the time $t_5$, the air-fuel ratio adjustment amount AFC of the exhaust gas flowing into the upstream side catalyst 20 is set to the weak lean set adjustment amount AFClean. Therefore, the target air-fuel ratio of the exhaust gas flowing into the upstream side catalyst 20 is set to the lean air-fuel ratio and, along with this, the output current Irup of the upstream side air-fuel ratio sensor 40 becomes a positive value. The exhaust gas flowing into the upstream side catalyst 20 contains oxygen, and therefore the oxygen storage amount OSAsc of the upstream side catalyst 20 gradually increases. At the time $t_6$, in the same way as the time $t_3$, the oxygen storage amount OSAsc increases over the upper limit storage amount.

Next, at the time $t_7$, in the same way as the time $t_4$, the output current Irdwn of the downstream side air-fuel ratio sensor 41 reaches the lean judged reference value Irefle and the air-fuel ratio adjustment amount AFC is switched to the value AFCrich which corresponds to the rich set air-fuel ratio. After that, the cycle of above-mentioned times $t_3$ to $t_6$ is repeated.

Note that, such an air-fuel ratio adjustment amount AFC is controlled by the ECU 31. Therefore, the ECU 31 can be said to comprise: a recovery period rich control means for continuously or intermittently setting the target air-fuel ratio of the exhaust gas flowing into the upstream side catalyst 20 to a rich air-fuel ratio, when the air-fuel ratio of the exhaust gas detected by the downstream side air-fuel ratio sensor 41 becomes the lean judged air-fuel ratio or more, until the oxygen storage amount OSAsc of the upstream side catalyst 20 becomes the upstream side lower limit storage amount Clowup; and a recovery period lean control means for continuously or intermittently setting the target air-fuel ratio to a weak lean air-fuel ratio, when the oxygen storage amount OSAsc of the upstream side catalyst 20 becomes the upstream side lower limit storage amount Clowup or less, so that the oxygen storage amount OSAsc increases toward the maximum oxygen storage amount without reaching zero.

Further, in the present embodiment, the difference between the time average value of the target air-fuel ratio and the stoichiometric air-fuel ratio when the recovery period rich control means continuously or intermittently sets the target air-fuel ratio richer than the stoichiometric air-fuel ratio, is larger than the difference between the time average value of the target air-fuel ratio and the stoichiometric air-fuel ratio when the recovery period lean control means continuously or intermittently sets the target air-fuel ratio leaner than the stoichiometric air-fuel ratio.

In the present embodiment, the target air-fuel ratio during storage amount recovery control was set as explained above, and therefore the oxygen storage amount of the downstream side catalyst 24 gradually increases. For this reason, it is possible to keep low the possibility of something causing the oxygen storage amount OSAufc of the downstream side catalyst 24 to reach the maximum oxygen storage amount during storage amount recovery control.

Fifth Embodiment

Next, referring to FIGS. 16 to 20, a control system of an internal combustion engine according to a fifth embodiment of the present invention will be explained. The configuration and control of the control system of an internal combustion engine of the fifth embodiment are basically the same as the configuration and control of the control system of an internal combustion engine of the above embodiments. However, in the above embodiments, the same sensor applied voltage was applied in both the upstream side air-fuel ratio sensor and the downstream side air-fuel ratio sensor, but in the present embodiment, different sensor applied voltages are applied in these air-fuel ratio sensors.

<Output Characteristic of Air-Fuel Ratio Sensor>

Figure 16:
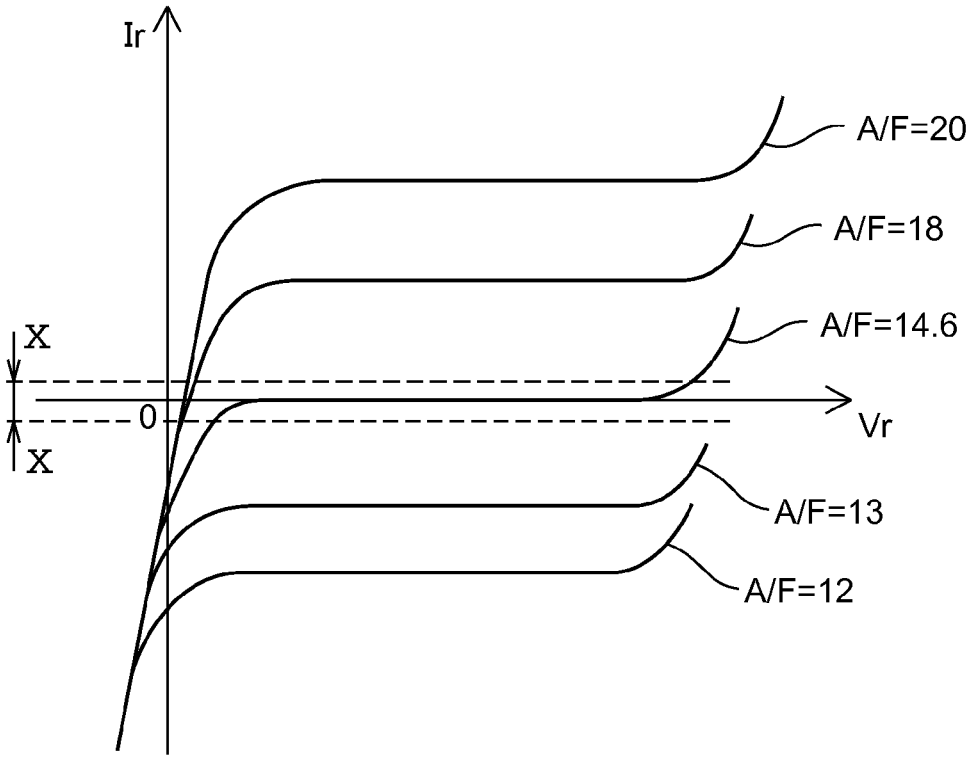
FIG. 16 is a view which shows the relationship between a sensor applied voltage and output current at different exhaust air-fuel ratios.

The upstream side air-fuel ratio sensor 40 and the downstream side air-fuel ratio sensor 41 of the present embodiment, in the same way as the air-fuel ratio sensors 40, 41 of the first embodiment, are configured and operate as explained using FIG. 3 and FIG. 4. These air-fuel ratio sensors 40, 41 have the voltage-current (V-I) characteristics such as shown in FIG. 16. As will be understood from FIG. 16, in the region where the sensor applied voltage Vr is 0 or less and near 0, if the exhaust air-fuel ratio is constant, if the sensor applied voltage Vr gradually increases from a negative value, the output current Ir increases along with this.

That is, in this voltage region, since the sensor applied voltage Vr is low, the flow rate of oxygen ions which can move through the solid electrolyte layer 51 is small. For this reason, the flow rate of oxygen ions which can move through the solid electrolyte layer 51 becomes smaller than the rate of inflow of exhaust gas through the diffusion regulating layer 54 and, accordingly, the output current Ir changes in accordance with the flow rate of oxygen ions which can move through the solid electrolyte layer 51. The flow rate of oxygen ions which can move through the solid electrolyte layer 51 changes in accordance with the sensor applied voltage Vr, and, as a result, the output current increases along with the increase in the sensor applied voltage Vr. Note that, the voltage region where the output current Ir changes in proportion to the sensor applied voltage Vr in this way is called the "proportional region". Further, when the sensor applied voltage Vr is 0, the output current Ir becomes a negative value since an electromotive force E according to the oxygen concentration ratio is generated between the two lateral surfaces of the solid electrolyte layer 51, by the oxygen cell characteristic.

Then, if leaving the exhaust air-fuel ratio constant and gradually increasing the sensor applied voltage Vr, the ratio of increase of output current to the increase of the voltage will gradually become smaller and will finally substantially be saturated. As a result, even if increasing the sensor applied voltage Vr, the output current will no longer change much at all. This substantially saturated current is called the "limit current". Below, the voltage region where this limit current occurs will be called the "limit current region".

That is, in this limit current region, the sensor applied voltage Vr is high to a certain extent, and therefore the flow rate of oxygen ions which can move through the solid electrolyte layer 51 is large. Therefore, the flow rate of oxygen ions which can move through the solid electrolyte layer 51 becomes greater than the rate of inflow of exhaust gas through the diffusion regulating layer 54. Therefore, the output current Ir changes in accordance with the concentration of oxygen or concentration of unburned gas in the exhaust gas flowing into the measured gas chamber 57 through the diffusion regulating layer 54. Even if making the exhaust air-fuel ratio constant and changing the sensor applied voltage Vr, basically, the concentration of oxygen or concentration of unburned gas in the exhaust gas flowing into the measured gas chamber 57 through the diffusion regulating layer 54 does not change, and therefore the output voltage Ir does not change.

However, if the exhaust air-fuel ratio differs, the concentration of oxygen and concentration of unburned gas in the exhaust gas flowing into the measured gas chamber 57 through the diffusion regulating layer 54 also differ, and therefore the output current Ir changes in accordance with the exhaust air-fuel ratio. As will be understood from FIG. 16, between the lean air-fuel ratio and the rich air-fuel ratio, the direction of flow of the limit current is opposite. At the time of the lean air-fuel ratio, the absolute value of the limit current becomes larger the larger the air-fuel ratio, while at the time of the rich air-fuel ratio, the absolute value of the limit current becomes larger the smaller the air-fuel ratio.

Then, if holding the exhaust air-fuel ratio constant and further increasing the sensor applied voltage Vr, the output current Ir again starts to increase along with the increase in the voltage. If applying a high sensor applied voltage Vr in this way, the moisture which is contained in the exhaust gas breaks down on the exhaust side electrode 52. Along with this, current flows. Further, if further increasing the sensor applied voltage Vr, even with just breakdown of moisture, the current no longer becomes sufficient. At this time, the solid electrolyte layer 51 breaks down. Below, the voltage region where moisture and the solid electrolyte layer 51 break down in this way will be called the "moisture breakdown region".

Figure 17:
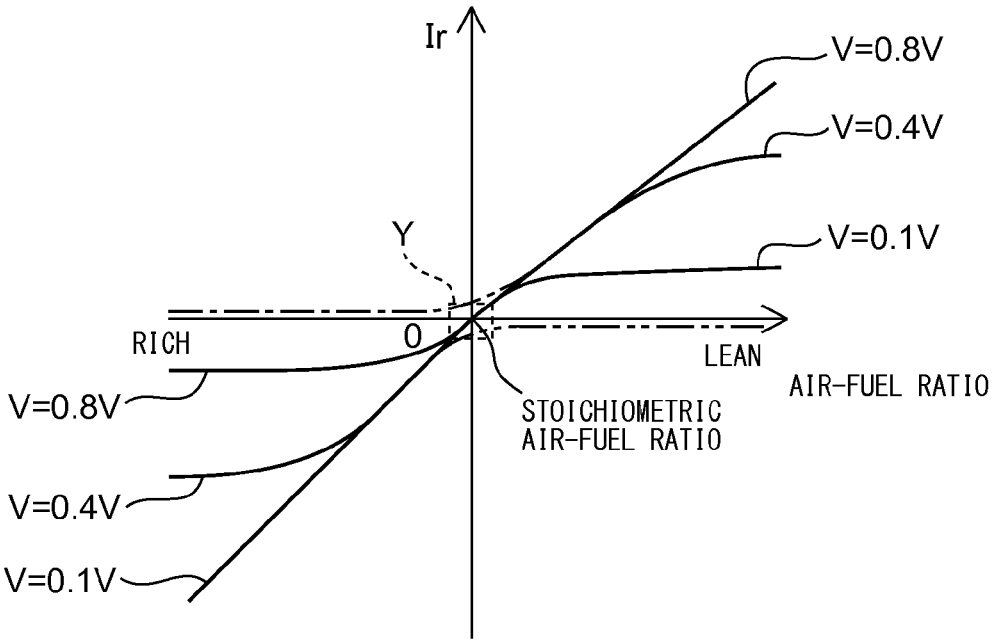
FIG. 17 is a view which shows the relationship between the exhaust air-fuel ratio and output current at different sensor applied voltages.

FIG. 17 is a view which shows the relationship between the exhaust air-fuel ratio and the output current Ir at different sensor applied voltages Vr. As will be understood from FIG. 17, if the sensor applied voltage Vr is 0.1V to 0.9V or so, the output current Ir changes in accordance with the exhaust air-fuel ratio at least near the stoichiometric air-fuel ratio. Further, as will be understood from FIG. 17, if sensor applied voltage Vr is 0.1V to 0.9V or so, near the stoichiometric air-fuel ratio, the relationship between the exhaust air-fuel ratio and the output current Ir is substantially the same regardless of the sensor applied voltage Vr.

On the other hand, as will be understood from FIG. 17, if the exhaust air-fuel ratio becomes lower than a certain exhaust air-fuel ratio or less, the output current Ir no longer changes much at all even if the exhaust air-fuel ratio changes. This certain exhaust air-fuel ratio changes in accordance with the sensor applied voltage Vr. It becomes higher the higher the sensor applied voltage Vr. For this reason, if making the sensor applied voltage Vr increase to a certain specific value or more, as shown in the figure by the one-dot chain line, no matter what the value of the exhaust air-fuel ratio, the output current Ir will no longer become 0.

On the other hand, if the exhaust air-fuel ratio becomes higher than a certain exhaust air-fuel ratio or more, the output current Ir no longer changes much at all even if the exhaust air-fuel ratio changes. This certain exhaust air-fuel ratio also changes in accordance with the sensor applied voltage Vr. It becomes lower the lower the sensor applied voltage Vr. For this reason, if making the sensor applied voltage Vr decrease to a certain specific value or less, as shown in the figure by the two-dot chain line, no matter what the value of the exhaust air-fuel ratio, the output current Ir will no longer become 0 (for example, when the sensor applied voltage Vr is set to 0V, the output current Ir does not become 0 regardless of the exhaust air-fuel ratio).

<Microscopic Characteristics near Stoichiometric Air-Fuel Ratio>

The inventors of the present invention engaged in in-depth research whereupon they discovered that if viewing the relationship between the sensor applied voltage Vr and the output current Ir (FIG. 6) or the relationship between the exhaust air-fuel ratio and output current Ir (FIG. 7) macroscopically, they trend like explained above, but if viewing these relationships microscopically near the stoichiometric air-fuel ratio, they trend differently from the above. Below, this will be explained.

Figure 18:
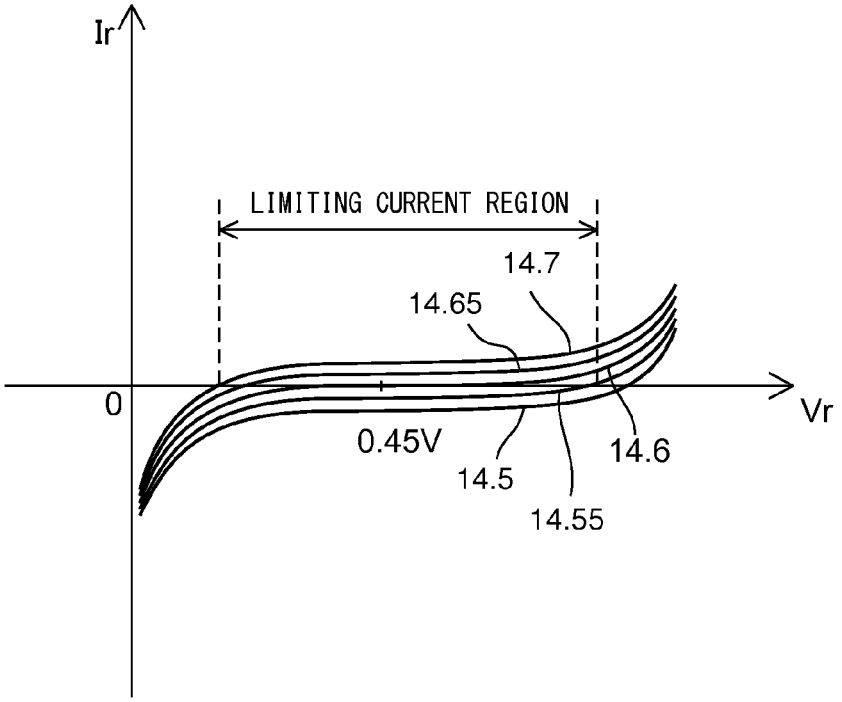
FIG. 18 is a view which shows enlarged the region which is shown by X-X in FIG. 16.

FIG. 18 is a view which shows enlarged the region where the output current Ir becomes near 0 (region shown by X-X in FIG. 16), regarding the voltage-current graph of FIG. 16. As will be understood from FIG. 18, even in the limit current region, when making the exhaust air-fuel ratio constant, the output current Ir also increases, though very slightly, along with the increase in the sensor applied voltage Vr. For example, considering the case where the exhaust air-fuel ratio is the stoichiometric air-fuel ratio (14.6) as an example, when the sensor applied voltage Vr is 0.45V or so, the output current Ir becomes 0. As opposed to this, if setting the sensor applied voltage Vr lower than 0.45V by a certain extent (for example, 0.2V), the output current becomes a value lower than 0. On the other hand, if setting the sensor applied voltage Vr higher than 0.45V by a certain extent (for example, 0.7V), the output current becomes a value higher than 0.

Figure 19:
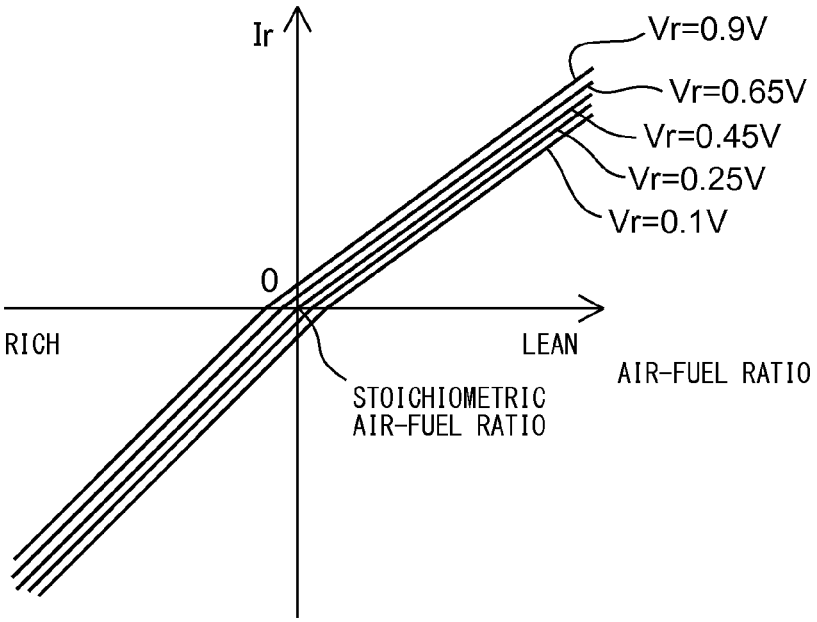
FIG. 19 is a view which shows enlarged the region which is shown by Y in FIG. 17.

FIG. 19 is a view which shows enlarged the region where the exhaust air-fuel ratio is near the stoichiometric air-fuel ratio and the output current Ir is near 0 (region shown by Yin FIG. 17), regarding the air-fuel ratio-current graph of FIG. 17. From FIG. 19, it will be understood that in the region near the stoichiometric air-fuel ratio, the output current Ir for the same exhaust air-fuel ratio slightly differs for each sensor applied voltage Vr. For example, in the illustrated example, when the exhaust air-fuel ratio is the stoichiometric air-fuel ratio, the output current Ir when the sensor applied voltage Vr is 0.45V becomes 0. Further, if setting the sensor applied voltage Vr larger than 0.45V, the output current Ir also becomes larger than 0. If making the sensor applied voltage Vr smaller than 0.45V, the output current Ir also becomes smaller than 0.

In addition, from FIG. 19, it will be understood that the exhaust air-fuel ratio when the output current Ir is 0 (below, referred to as "exhaust air-fuel ratio at the time of zero current") differs for each sensor applied voltage Vr. In the illustrated example, when the sensor applied voltage Vr is 0.45V, the output current Ir becomes 0 when the exhaust air-fuel ratio is the stoichiometric air-fuel ratio. As opposed to this, if the sensor applied voltage Vr is larger than 0.45V, the output current Ir becomes 0 when the exhaust air-fuel ratio is richer than the stoichiometric air-fuel ratio. The larger the sensor applied voltage Vr becomes, the smaller the exhaust air-fuel ratio at the time of zero current. Conversely, if the sensor applied voltage Vr is smaller than 0.45V, the output current Ir becomes 0 when the exhaust air-fuel ratio is leaner than the stoichiometric air-fuel ratio. The smaller the sensor applied voltage Vr, the larger the exhaust air-fuel ratio at the time of zero current. That is, by making the sensor applied voltage Vr change, it is possible to change the exhaust air-fuel ratio at the time of zero current.

In this regard, the slant in FIG. 5, that is, the ratio of the amount of increase of output current to the amount of increase of the exhaust air-fuel ratio (below, called the "rate of change of output current"), will not necessarily become the same after similar production processes. Even with the same type of air-fuel ratio sensor, variations will occur between individuals. In addition, even in the same air-fuel ratio sensor, the rate of change of output current will change due to aging, etc. As a result, even if using the same type of sensor configured so as to have the output characteristic shown by the solid line A in FIG. 20, depending on the sensor used or the duration of use, etc., the rate of change of output current will become smaller as shown by the broken line B in FIG. 20 or the rate of change of output current will become larger as shown by the one-dot chain line C.

Therefore, even when using the same type of air-fuel ratio sensor to measure the same air-fuel ratio of exhaust gas, the output current of the air-fuel ratio sensor will differ depending on the sensor used or the usage time, etc. For example, when the air-fuel ratio sensor has an output characteristic such as shown by the solid line A, the output current when measuring exhaust gas with an air-fuel ratio of $af_1$ becomes $I_2$. However, when the air-fuel ratio sensor has an output characteristic such as shown by the broken line B or the one-dot chain line C, the output currents when measuring exhaust gas with an air-fuel ratio of $af_1$ become respectively $I_1$ and $I_3$ and thus become output currents which are different from the above-mentioned $I_2$.

Figure 20:
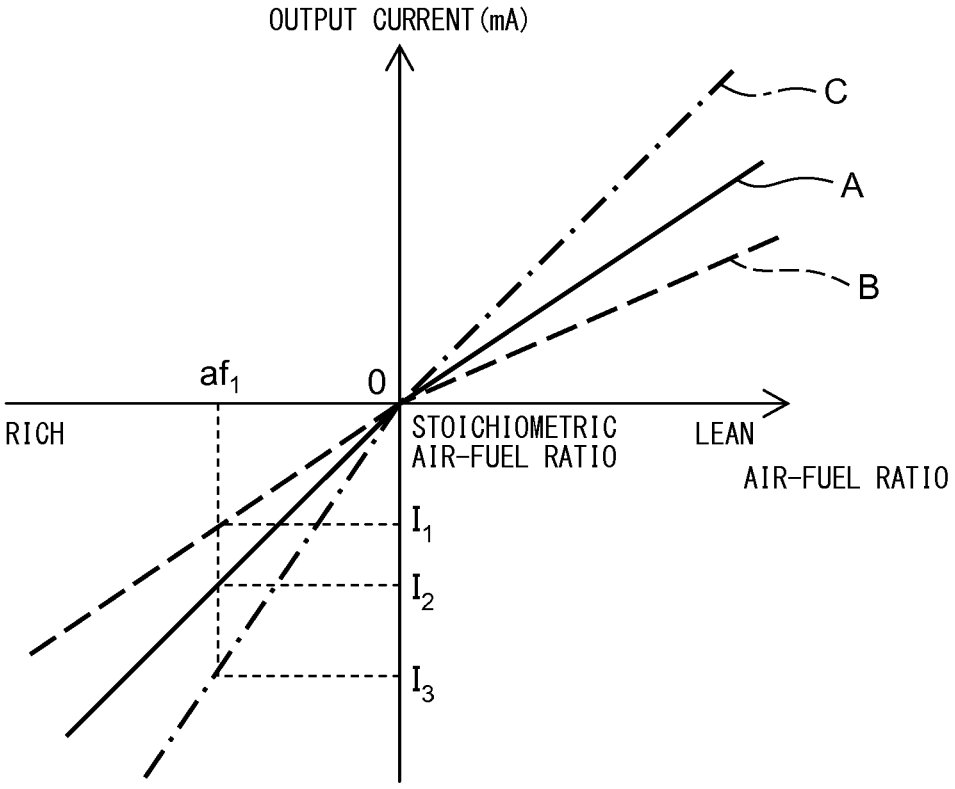
FIG. 20 is a view which shows the relationship between the air-fuel ratio and the output current, of the air-fuel ratio sensor.

However, as will be understood from FIG. 20, even if variations occur between individuals of the air-fuel ratio sensor or variations occur in the same air-fuel ratio sensor due to aging, there is almost no change in the exhaust air-fuel ratio at the time of zero current (in the example of FIG. 20, the stoichiometric air-fuel ratio). That is, when the output current Ir is a value other than zero, the absolute value of the exhaust air-fuel ratio is difficult to accurately detect, but when the output current Ir becomes zero, the absolute value of the exhaust air-fuel ratio (in the example of FIG. 20, the stoichiometric air-fuel ratio) can be accurately detected.

Further, as explained using FIG. 19, in the air-fuel ratio sensors 40, 41, by changing the sensor applied voltage Vr, it is possible to change the exhaust air-fuel ratio at the time of zero current. That is, if suitably setting the sensor applied voltage Vr, it is possible to accurately detect the absolute value of an exhaust air-fuel ratio other than the stoichiometric air-fuel ratio. In particular, when changing the sensor applied voltage Vr within a later explained "specific voltage region", it is possible to adjust the exhaust air-fuel ratio at the time of zero current only slightly with respect to the stoichiometric air-fuel ratio (14.6) (for example, within a range of ±1% (about 14.45 to about 14.75)). Therefore, by suitably setting the sensor applied voltage Vr, it becomes possible to accurately detect the absolute value of an air-fuel ratio which slightly differs from the stoichiometric air-fuel ratio.

Note that, as explained above, by changing the sensor applied voltage Vr, it is possible to change the exhaust air-fuel ratio at the time of zero current. However, if changing the sensor applied voltage Vr so as to be larger than a certain upper limit voltage or smaller than a certain lower limit voltage, the amount of change in the exhaust air-fuel ratio at the time of zero current, with respect to the amount of change in the sensor applied voltage Vr, becomes larger. Therefore, in these voltage regions, if the sensor applied voltage Vr slightly shifts, the exhaust air-fuel ratio at the time of zero current greatly changes. Therefore, in this voltage region, to accurately detect the absolute value of the exhaust air-fuel ratio, it becomes necessary to precisely control the sensor applied voltage Vr. This is not that practical. Therefore, from the viewpoint of accurately detecting the absolute value of the exhaust air-fuel ratio, the sensor applied voltage Vr has to be a value within a "specific voltage region" between a certain upper limit voltage and a certain lower limit voltage.

In this regard, as shown in FIG. 19, the air-fuel ratio sensors 40, 41 have a limit current region which is a voltage region where the output current Ir becomes a limit current for each exhaust air-fuel ratio. In the present embodiment, the limit current region when the exhaust air-fuel ratio is the stoichiometric air-fuel ratio is defined as the "specific voltage region".

Note that, as explained using FIG. 7, if increasing the sensor applied voltage Vr to a certain specific value (maximum voltage) or more, as shown in the figure by the one-dot chain line, no matter what value the exhaust air-fuel ratio is, the output current Ir will no longer become 0. On the other hand, if decreasing the sensor applied voltage Vr to a certain specific value (minimum voltage) or less, as shown in the figure by the two-dot chain line, no matter what value the exhaust air-fuel ratio, the output current Ir will no longer become 0.

Therefore, if the sensor applied voltage Vr is a voltage between the maximum voltage and the minimum voltage, there is an exhaust air-fuel ratio where the output current becomes zero. Conversely, if the sensor applied voltage Vr is a voltage higher than the maximum voltage or a voltage lower than the minimum voltage, there is no exhaust air-fuel ratio where the output current will become zero. Therefore, the sensor applied voltage Vr at least has to be able to be a voltage where the output current becomes zero when the exhaust air-fuel ratio is any air-fuel ratio, that is, a voltage between the maximum voltage and the minimum voltage. The above-mentioned "specific voltage region" is the voltage region between the maximum voltage and the minimum voltage.

<Applied Voltages at Different Air-Fuel Ratio Sensors>

In the present embodiment, in consideration of the above-mentioned microscopic characteristics, when the air-fuel ratio of the exhaust gas is detected by the upstream side air-fuel ratio sensor 40, the sensor applied voltage Vrup at the upstream side air-fuel ratio sensor 40 is fixed to a voltage whereby the output current becomes zero when the exhaust air-fuel ratio is the stoichiometric air-fuel ratio (in the present embodiment, 14.6) (for example, 0.45V). In other words, at the upstream side air-fuel ratio sensor 40, the sensor applied voltage Vrup is set so that the exhaust air-fuel ratio at the time of zero current becomes the stoichiometric air-fuel ratio. On the other hand, when the air-fuel ratio of the exhaust gas is detected by the downstream side air-fuel ratio sensor 41, the sensor applied voltage Vr at the downstream side air-fuel ratio sensor 41 is fixed to a constant voltage (for example, 0.7V) so that the output current becomes zero when the exhaust air-fuel ratio is a predetermined rich judged air-fuel ratio which is slightly richer than the stoichiometric air-fuel ratio (for example, 14.55). In other words, the sensor applied voltage Vrdwn is set so that, in the downstream side air-fuel ratio sensor 41, the exhaust air-fuel ratio at the time of the current zero becomes a rich judged air-fuel ratio which is slightly richer than the stoichiometric air-fuel ratio. In this way, in the present embodiment, the sensor applied voltage Vrdwn at the downstream side air-fuel ratio sensor 41 is set to a voltage which is higher than the sensor applied voltage Vrup at the upstream side air-fuel ratio sensor 40.

Therefore, the ECU 31 which is connected to the two air-fuel ratio sensors 40, 41 judges that the exhaust air-fuel ratio around the upstream side air-fuel ratio sensor 40 is the stoichiometric air-fuel ratio when the output current Irup of the upstream side air-fuel ratio sensor 40 becomes zero. On the other hand, the ECU 31 judges that the exhaust air-fuel ratio around the downstream side air-fuel ratio sensor 41 is a rich judged air-fuel ratio, that is, a predetermined air-fuel ratio which is different from the stoichiometric air-fuel ratio, when the output current Irdwn of the downstream side air-fuel ratio sensor 41 becomes zero. Due to this, the downstream side air-fuel ratio sensor 41 can accurately detect the rich judged air-fuel ratio.

REFERENCE SIGNS LIST

5. combustion chamber
6. intake valve
8. exhaust valve
10. spark plug
11. fuel injector
13. intake branch pipe
15. intake pipe
18. throttle valve
19. exhaust manifold
20. upstream side catalyst
21. upstream side casing
22. exhaust pipe
23. downstream side casing
24. downstream side catalyst

31. ECU

39. air flow meter

40. upstream side air-fuel ratio sensor

41. downstream side air-fuel ratio sensor

The invention claimed is:

1. A control system of an internal combustion engine, the engine comprising an upstream side catalyst which is provided in an exhaust passage of the internal combustion engine, and a downstream side catalyst which is provided in said exhaust passage at a downstream side, in the direction of flow of exhaust, from said upstream side catalyst, said control system comprising:

a downstream side air-fuel ratio sensor which is provided in said exhaust passage between said upstream side catalyst and said downstream side catalyst;

an inflow air-fuel ratio control device which controls an air-fuel ratio of exhaust gas flowing into said upstream side catalyst so that said air-fuel ratio of the exhaust gas becomes a target air-fuel ratio; and an electronic control unit (ECU) configured to perform:

an estimation of an oxygen storage amount of said downstream side catalyst;

a normal period lean control for setting said target air-fuel ratio of exhaust gas flowing into said upstream side catalyst continuously or intermittently to leaner than a stoichiometric air-fuel ratio, when an air-fuel ratio detected by said downstream side air-fuel ratio sensor becomes a rich judged air-fuel ratio, which is richer than the stoichiometric air-fuel ratio, or less, until an oxygen storage amount of the upstream side catalyst becomes a given upstream side judged reference storage amount smaller than a maximum oxygen storage amount;

a normal period rich control for setting said target air-fuel ratio continuously or intermittently to richer than a stoichiometric air-fuel ratio, when said oxygen storage amount of the upstream side catalyst becomes said upstream side judged reference storage amount or more so that said oxygen storage amount decreases toward zero without reaching the maximum oxygen storage amount; and a storage amount recovery control for setting said target air-fuel ratio continuously or intermittently to leaner than the stoichiometric air-fuel ratio, when the estimated oxygen storage amount of said downstream side catalyst becomes a given downstream side lower limit storage amount, which is smaller than the maximum storage amount, or less, so that the air-fuel ratio of the exhaust gas flowing out from said upstream side catalyst never becomes richer than the stoichiometric air-fuel ratio but continuously or intermittently becomes leaner than the stoichiometric air-fuel ratio, without performing said normal period rich control and normal period lean control.

2. The control system of an internal combustion engine according to claim 1, wherein in said storage amount recovery control, said ECU continues to set said target air-fuel ratio until the oxygen storage amount of said downstream side catalyst becomes a given downstream side upper limit storage amount which is greater than said downstream side lower limit storage amount and which is less than the maximum oxygen storage amount.

3. The control system of an internal combustion engine according to claim 1, wherein in said storage amount recovery control, said ECU intermittently sets said target air-fuel ratio leaner than the stoichiometric air-fuel ratio so that the air-fuel ratio of the exhaust gas flowing out from said upstream side catalyst intermittently becomes leaner than the stoichiometric air-fuel ratio.

4. The control system of an internal combustion engine according to claim 3, wherein in said storage amount recovery control said ECU performs: a recovery period rich control for continuously or intermittently setting said target air-fuel ratio richer than the stoichiometric air-fuel ratio, when the air-fuel ratio detected by said downstream side air-fuel ratio sensor becomes a lean judged air-fuel ratio, which is leaner than the stoichiometric air-fuel ratio, or more, until said oxygen storage amount of the upstream side catalyst becomes a given upstream side lower limit storage amount which is greater than zero; and a recovery period lean control for continuously or intermittently setting said target air-fuel ratio to lean when said oxygen storage amount of the upstream side catalyst becomes said upstream side lower limit storage amount or less, so that the oxygen storage amount increases toward the maximum oxygen storage amount without reaching zero.

5. The control system of an internal combustion engine according to claim 4, wherein a difference between a time average value of said target air-fuel ratio and stoichiometric air-fuel ratio when said target air-fuel ratio is continuously or intermittently set richer than the stoichiometric air-fuel ratio in said recovery period rich control, is larger than a difference between a time average value of said target air-fuel ratio and stoichiometric air-fuel ratio when said target air-fuel ratio is continuously or intermittently set leaner than the stoichiometric air-fuel ratio in said recovery period lean control.

6. The control system of an internal combustion engine according to claim 4, wherein in said recovery period rich control, said ECU continuously sets said target air-fuel ratio richer than the stoichiometric air-fuel ratio.

7. The control system of an internal combustion engine according to claim 4, wherein in said recovery period rich control, said ECU continuously sets said target air-fuel ratio leaner than the stoichiometric air-fuel ratio.

8. The control system of an internal combustion engine according to claim 1, wherein in said storage amount recovery control, said ECU continuously sets said target air-fuel ratio leaner than the stoichiometric air-fuel ratio.

9. The control system of an internal combustion engine according to claim 8, wherein a difference between a time average value of said target air-fuel ratio and stoichiometric air-fuel ratio when said target air-fuel ratio is continuously set leaner than the stoichiometric air-fuel ratio in said storage amount recovery control is not less than a difference between a time average value of said target air-fuel ratio and stoichiometric air-fuel ratio when said target air-fuel ratio is continuously or intermittently set leaner than the stoichiometric air-fuel ratio in said normal period lean control.

10. The control system of an internal combustion engine according to claim 8, wherein a difference between a time average value of said target air-fuel ratio and stoichiometric air-fuel ratio when said target air-fuel ratio is continuously set leaner than the stoichiometric air-fuel ratio in said storage amount recovery control is smaller than a difference between a time average value of said target air-fuel ratio and stoichiometric air-fuel ratio when said target air-fuel ratio is continuously or intermittently set leaner than the stoichiometric air-fuel ratio in said normal period lean control.

11. The control system of an internal combustion engine according to claim 8, wherein said ECU fixes said target air-fuel ratio at a constant air-fuel ratio over the time period during which said ECU performs said storage amount recovery control.

12. The control system of an internal combustion engine according to claim 8, wherein said ECU makes said target air-fuel ratio fall continuously or in stages in the time period during which said ECU performs said storage amount recovery control.

* * * * *